US005409545A

United States Patent [19]

Levey et al.

[11] Patent Number: 5,409,545

[45] Date of Patent: Apr. 25, 1995

[54] APPARATUS AND METHOD FOR CLEANING CONTAINERS

[75] Inventors: William D. Levey, Oakland; William J. Sell, Petaluma; Brett Wilmarth, Gilroy, all of Calif.

[73] Assignee: Environmental Sampling Supply, Inc., Oakland, Calif.

[21] Appl. No.: 27,115

[22] Filed: Mar. 4, 1993

[51] Int. Cl.[6] ..... B08B 3/02; B08B 9/08

[52] U.S. Cl. ..... 134/22.18; 134/24; 134/25.4; 134/46; 134/49; 134/57 R; 134/129; 134/133; 134/167 R

[58] Field of Search ..... 134/22.18, 24, 25.4, 134/56 R, 57 R, 46, 49, 50, 68, 72, 83, 129, 131, 133, 134, 152, 167 R, 168 R, 171; 15/304

[56] References Cited

U.S. PATENT DOCUMENTS

| | | | |
|---|---|---|---|
| 743,155 | 11/1903 | Eick | 134/167 R |
| 934,870 | 9/1909 | Wolfensberger | 134/134 |
| 1,265,413 | 5/1918 | Wright | 134/49 |
| 1,400,894 | 12/1921 | Mason | 134/49 X |
| 1,940,615 | 12/1933 | Webster | 134/167 R |
| 2,522,310 | 9/1950 | Smith | 134/168 R X |
| 2,522,912 | 9/1950 | Weiss | 198/803.15 X |
| 2,681,872 | 6/1954 | McCabe | 134/23 |
| 2,947,311 | 8/1960 | Fox et al. | 134/133 X |
| 3,129,713 | 4/1964 | Read | 134/73 |
| 3,302,655 | 2/1967 | Sasaki | 134/79 |
| 3,985,226 | 10/1976 | Noren | 134/133 X |
| 4,010,774 | 3/1977 | Fischer | 134/167 R X |
| 4,125,120 | 11/1978 | Standley | 134/171 X |
| 4,154,624 | 5/1979 | Wahl et al. | 134/10 |
| 4,512,811 | 4/1985 | Binnig et al. | 134/10 |
| 4,667,690 | 5/1987 | Hartnig | 134/62 |

FOREIGN PATENT DOCUMENTS

| | | | |
|---|---|---|---|
| 1077818 | 5/1954 | France | 134/171 |
| 16447 | 1/1882 | Germany | 134/167 R |
| 708561 | 7/1941 | Germany | 134/83 |
| 278223 | 11/1964 | Netherlands | 134/167 R |
| 357398 | 9/1931 | United Kingdom | 134/83 |

*Primary Examiner*—Philip R. Coe
*Attorney, Agent, or Firm*—Donald L. Beeson

[57] ABSTRACT

An apparatus and method for cleaning containers, such as sample containers for environmental testing, involves providing modular cleaning bays into which an array of inverted containers can be transported, such as by means of a drive chain. Independently operable nozzle banks disposed in the cleaning bay generally below the resident container tray are driven in an x-axis motion, such as by a stepper motor, to register a selected nozzle bank with successive rows of containers within the tray. At each row of containers the nozzle bank, which is selected in accordance with the size and spacing of the containers being processed, is caused to travel in a z-axis motion through a process cycle in which the nozzle elements of the nozzle bank traverse through the open mouth ends of the containers registered therewith and in which a fluid stream is projected directly onto the interior surfaces of the containers, preferably sweeping the entirety of those surfaces. The tray of containers is exited from the cleaning bay after the last row of containers in the tray is processed. Modular cleaning bays can be cascaded together for processing trays of containers through different washing and rinsing solutions, and for air drying the interior surfaces of the containers.

27 Claims, 16 Drawing Sheets

12/16

13/16

APPARATUS AND METHOD FOR CLEANING CONTAINERS

BACKGROUND OF THE INVENTION

The present invention relates to an apparatus and method for cleaning containers, and especially glass or plastic sample containers for environmental testing. The invention more particularly relates to an automated cleaning apparatus and method which consistently removes impurities from the interior surfaces of sample containers, and which at the same time greatly increases throughput, that is, the rate at which the sample containers can be processed.

Sample containers used in the environmental industry to perform chemical analysis must be thoroughly cleaned before use and reuse in order to meet rigorous standards of cleanliness set by the U.S. Environmental Protection Agency (EPA). Even low levels of impurities left on container surfaces after cleaning can invalidate test results performed on a sample, for example, a soil sample, which has been held in the container. To meet strict EPA cleanliness standards, sample containers have heretofore been cleaned manually. Each container is individually hand-rinsed, usually in a non-phosphate detergent wash with tap water, and then hand-rinsed in a series of required solutions, typically in a rinsing sequence involving a nitric acid solution rinse, a deionized water rinse, and a solvent rinse, such a methylene chloride, for removing oils or grease. Manual washing processes are time intensive and often yield inconsistent results because of inattentive or fatigued workers who do not consistently rinse all the surfaces of every container.

In a known variation of the above described manual cleaning approach, sample containers, instead of being washed by hand, are washed in a conventional industrial grade dishwasher, such as a Hobart brand washer, before they are manually processed through the required rinses. In a conventional dishwasher, a spinning spray arm beneath the inverted containers projects a wash solution and tap water rinse up into and about the containers to wash both inside and outside container surfaces. A relatively small portion of the spray emitted by the spinning spray arm actually reaches the inside of the container, and that portion that does strike the container's inside surfaces does so at low pressure and in an uncontrolled fashion. As a consequence, cleansing of the critical inside surfaces of the container tends to be incomplete and inconsistent in terms of removing impurities to required levels. A conventional washer is also a wasteful process, requiring large amounts of fluid to be emitted by the spin arm compared to the amount of fluid actually contacting the container surfaces.

U.S. Pat. No. 4,667,690 to Hartnig discloses yet another approach to washing containers, in this instance washing bottles prior to being filled by a filling machine with a liquid content such as, for example, a carbonated drink. In Hartnig, the bottles are processed on a continuous straight line conveyor system, rather than in a batch process. The rinsing cycle involves conveying the bottles in an inverted position over nozzles which are mounted on a rotating platform that is synchronized with the bottles. While this continuous process provides a more direct spray into the mouth of the inverted bottle, the spray still only reaches the inside surfaces of the bottle from a source outside the container. Thus, in Hartnig the spray is likely to reach only a portion of the interior surfaces of the container and the portions of the surfaces it does reach is reached at different angles and thus with varying degrees of effective scouring force. A cascade of fluid must be relied upon to clean a portion of the surfaces, and particularly shoulder surfaces near the neck of the container. Such limitations become particularly crucial when the cleanliness of the bottles must meet exacting EPA or similar standards.

The present invention is intended to overcome the disadvantages of existing approaches to cleansing sample containers and other types of containers. The invention improves over existing manual processes by greatly increasing throughput and providing consistent results. The invention also improves on the efficacy of existing automated and semi-automated approaches, whether involving batch or continuous processing, by providing a more direct, even, and consistent high pressure spray or fluid stream to the interior container surfaces to impart a more complete and thorough scouring action to these surfaces. The invention is uniquely adapted to handling a variety of container types and sizes, such as Boston round bottles, amber wide mouth round packer jars, cream jars, straight sided (paragon) jars, modern round and cylinder round plastic containers, and vials, and conserves fluids by efficiently directing sprays to surfaces to be cleaned in a focused manner. Finally, the invention provides for modular units that can flexibly be cascaded together to provide different cleaning, rinse and drying functions.

SUMMARY OF THE INVENTION

Briefly, the apparatus and method of the invention involves registering the nozzle elements of a nozzle bank with the mouth ends of the containers to be cleaned and causing the nozzle elements to traverse through the mouth ends of the containers so as to provide from within the containers themselves a direct spray or fluid stream to the container's interior surfaces. It is understood that the invention might be adapted to continuous processing wherein containers are continually fed through the cleaning system in a manner in which registration of the nozzles and containers and insertion of the nozzles into the containers continuously takes places. However, the invention is best adapted to batch processing as more fully described below.

The apparatus of the invention includes a cleaning bay; means for supporting containers in an inverted position within a cleaning bay, preferably in the form of a tray; means for supplying a spray of fluid to the cleaning bay including at least one nozzle element disposed in the cleaning bay generally below the container support means; means for registering the nozzle element or elements with the open mouth end or ends of any selected one or set of the inverted containers supported in the bay; and means for generating a process cycle in which the nozzle element is caused to traverse in a z-axis motion through the mouth end of the container registered therewith to provide a direct fluid spray to the interior surfaces of the container. While the use of a single nozzle element is within the scope of the invention, preferably the fluid spray supply means includes a nozzle bank having a set of nozzle elements arranged in correspondence with the spaced relationship of the set of inverted containers supported in the cleaning bay. In the illustrated embodiment, the nozzle bank is comprised of nozzle elements arranged in a row on a manifold connected to a fluid supply. By advancing the manifold bank, the row of nozzle elements can be made to register with successive rows of containers within an array of containers. A set of independently operable nozzle banks having nozzle elements of different lengths and spacings can also be provided to accommodate different container sizes.

The illustrated and described means for generating a process cycle, that is a cycle wherein the nozzle bank is caused to traverse through the container's mouth end, includes a pneumatic cylinder means operative to move a selected nozzle bank in a z-axis motion between a fully retracted position below the overhead containers to a selectable indexed height which extends the nozzle element well into a container of a selected size. Fluid control means activates the fluid spray supply means preferably such that a fluid spray is emitted from the nozzle elements only when the nozzle elements traverse through the container.

As above mentioned, the invention in its preferred and illustrated form is a batch process. Specifically, a set of containers to be cleaned is loaded into a container support means which is preferably in the form of a support tray that is transported into the cleaning bay. In the illustrated embodiment the transporting means for the tray takes the form of a chain drive driven by a servo motor which precisely locates the tray within the bay at a pre-determined position. The chain drive later exits the tray from the bay after all containers supported in the tray are completely processed. To accommodate a variety of container shapes and sizes, tray inserts can be provided having appropriate spacer elements for supporting particular categories of containers in accordance with a predetermined spacing.

It is contemplated that multiple cleaning bays will be cascaded together such that a tray exited from one bay can be fed into the next bay. Individual bays can thus be provided to process the containers with different cleaning and rinsing solutions. For example, a five bay sequence can be provided to provide five required washes and rinses under EPA regulations as follows: a first bay can provide a detergent wash followed by a bay for a recirculated nitric acid solution rinse. Third, fourth and fifth bays can in turn provide de-ionized water rinses, a possible solvent rinse, and possibly an air dry, that is, where the fluid stream emitted by the nozzle elements is air. It is contemplated that the bays providing the detergent wash and de-ionized water rinses would also include a supplementary rinsing capability for cleansing the exterior surfaces of the containers.

The cascaded cleaning bays can be operated under computer control wherein container trays manually fed into the first bay are sequenced through and processed by each of the successive bays. The computer control establishes the bottle type to be cleaned, sequences the trays through the bays, and initiates and controls the process cycle in each bay wherein the bay's nozzle banks are cycled through the rows of inverted containers supported in a container tray. The computer control also provides for the capability of editing bottle type information, polling individual bays for status and process information, and other operator controlled features including emergency shut downs.

It is therefore seen that a primary object of the invention is to provide for an automated apparatus and method for cleaning containers to exacting standards, standards that particularly require impurities to be removed from the interior surfaces of sample containers, impurities that could contaminate sample materials held by the containers. It is a further object of the invention to provide an apparatus and method that increases throughput while achieving consistent results, and one that is flexible and minimizes waste. Other objects of the invention will be apparent from the following described drawings and description of the illustrated embodiment.

DETAILED DESCRIPTION OF THE ILLUSTRATED EMBODIMENT

The illustrated embodiment of the invention provides for a batch process in which a tray of inverted containers is processed through a series of separate cleaning bays, each of which performs a designated step in an overall cleaning process, including a washing step, various rinsing steps, and even a drying step. In each of the cleaning bays, substantially the entirety of the interior surfaces of the containers supported within the cleaning bays are subjected to a direct stream of fluid under high pressure during a process cycle which is hereinafter described in greater detail. Under computer control, trays of containers, after being sequentially hand-fed from a suitable loading platform into the first cleaning bay, are automatically processed through each of the subsequent cascaded cleaning bays, and exited from the final bay. The apparatus, as will be seen, can be readily programmed to process different container sizes and shapes.

Figure 1:
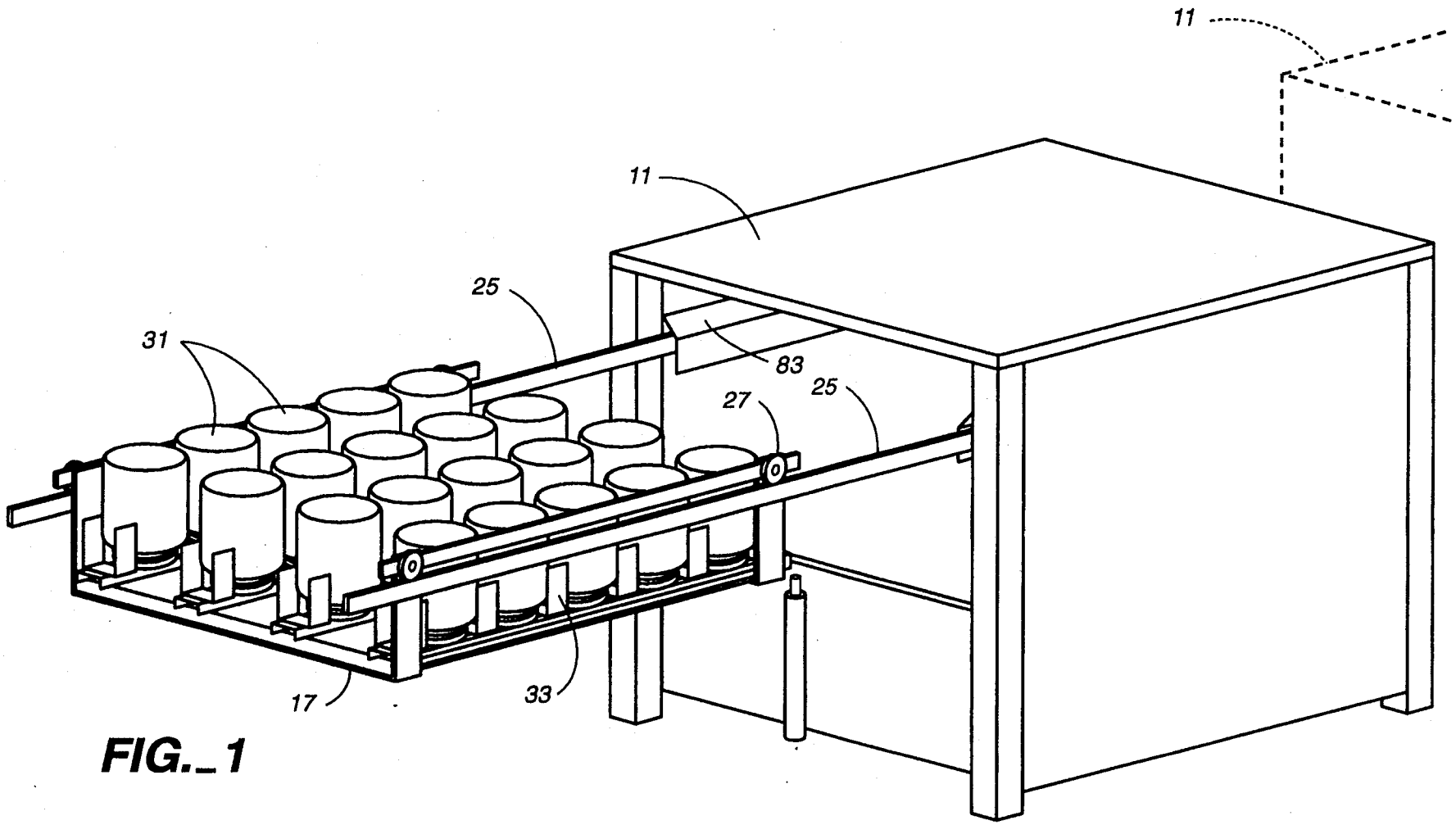
FIG. 1 is a perspective view of a cleaning bay in accordance with the invention showing a tray of containers being loaded into the bay.
Figure 4:
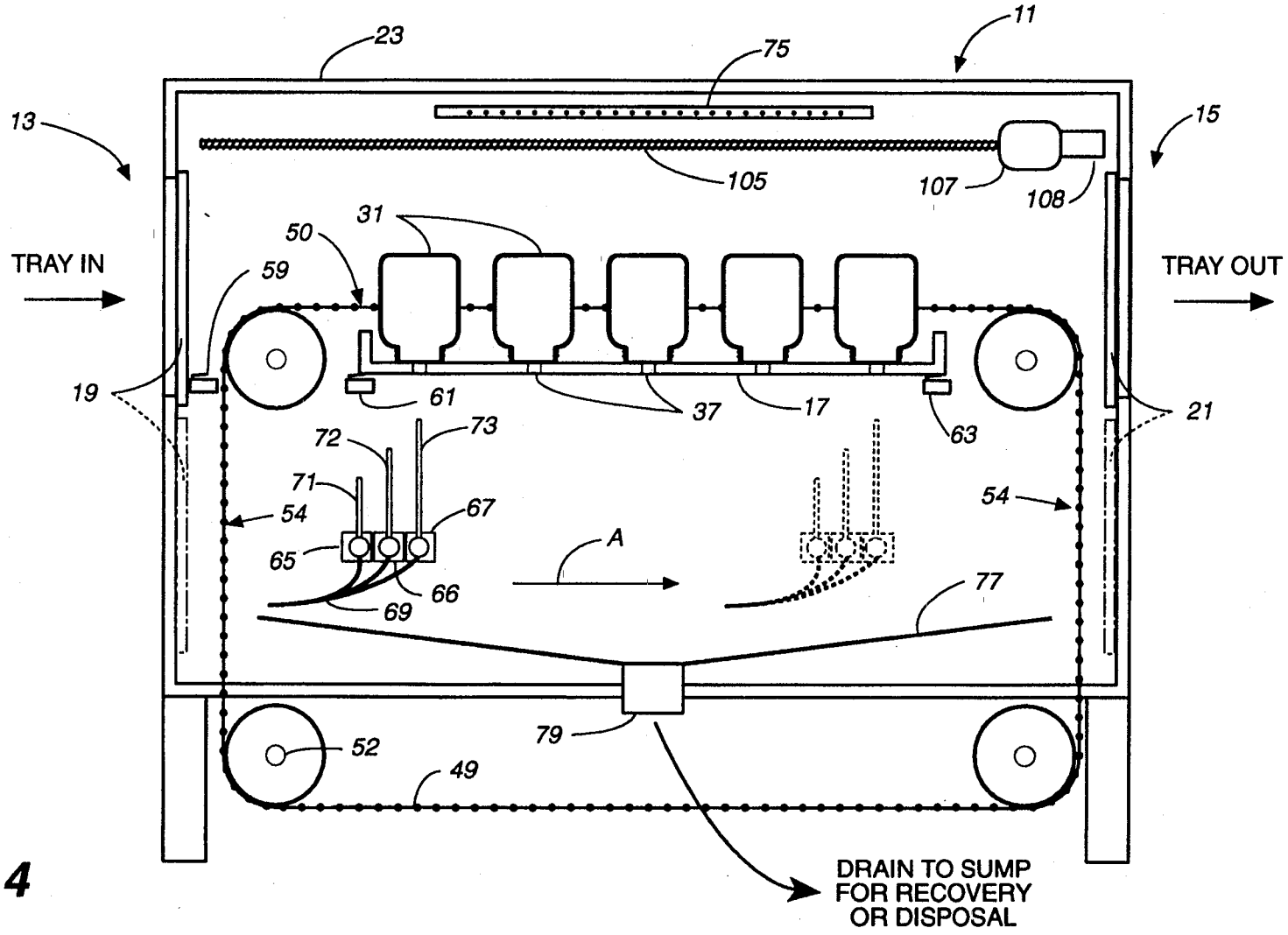
FIG. 4 is a diagrammatic view in side elevation of the interior of a cleaning bay showing the relative positioning of the container support tray and nozzle banks within the bay and the x-axis motion of the nozzle banks beneath the tray.
Figure 5:
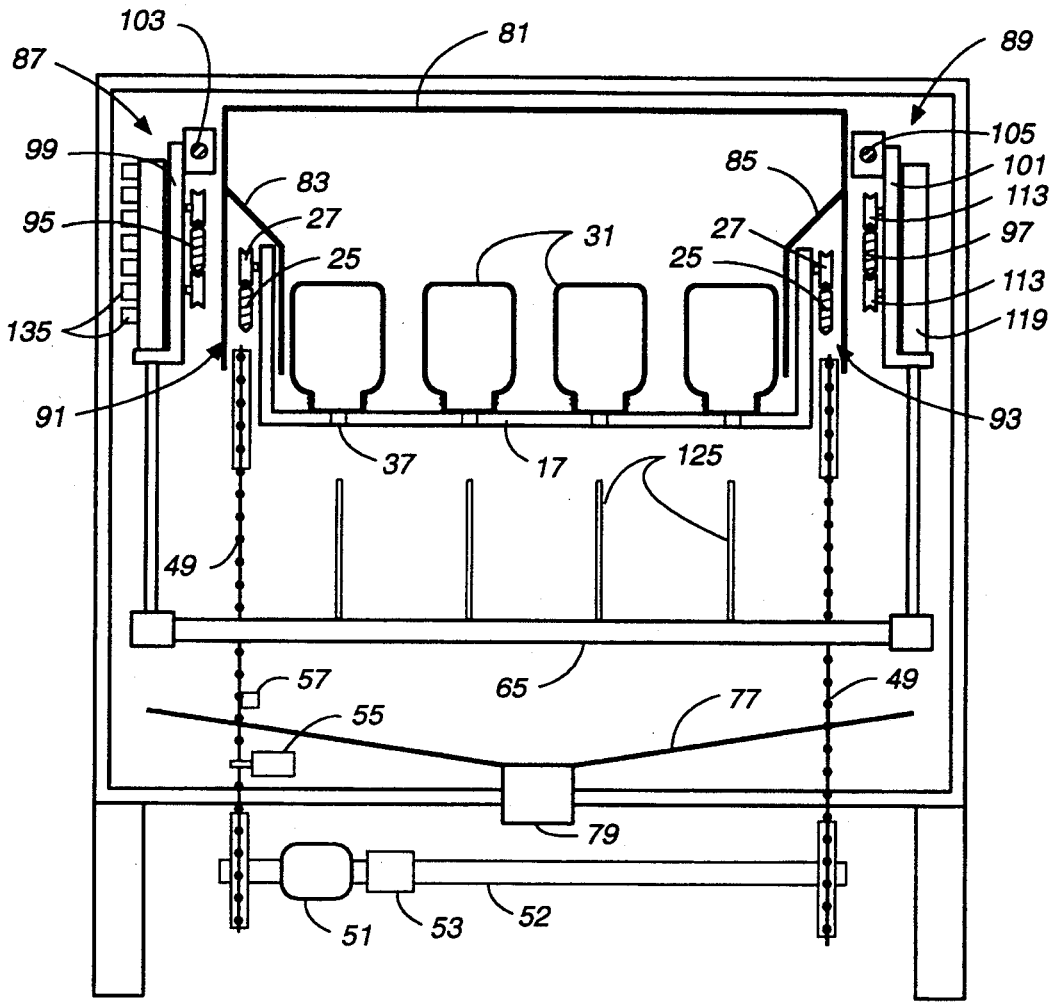
FIG. 5 is a diagrammatic end elevational view of the interior of the cleaning bay additionally showing the roller assemblies and air cylinders which carry and operate the nozzle banks, and the tray overhead splash guard.

Referring now to the drawings, FIGS. 1, 4 and 5 show a cleaning bay 11 having an infeed end 13 and an opposed outfeed end 15 for, respectively, receiving a tray of containers 17 into the cleaning bay and, after the containers have been processed, exiting the tray from the bay. Pneumatically actuated end doors (infeed door 19, and outfeed door 21) provide for closure of the infeed and outfeed ends of the cleaning bay when the container tray is resident within the bay. When the bays are cascaded together, closure of the bay doors acts to isolate one bay from another thereby eliminating cross-contamination between bays.

The top wall 23 of the cleaning bay can also suitably include a pneumatically actuated top door (not shown) to permit convenient access to the cleaning bay for inspection and maintenance.

Figure 2:
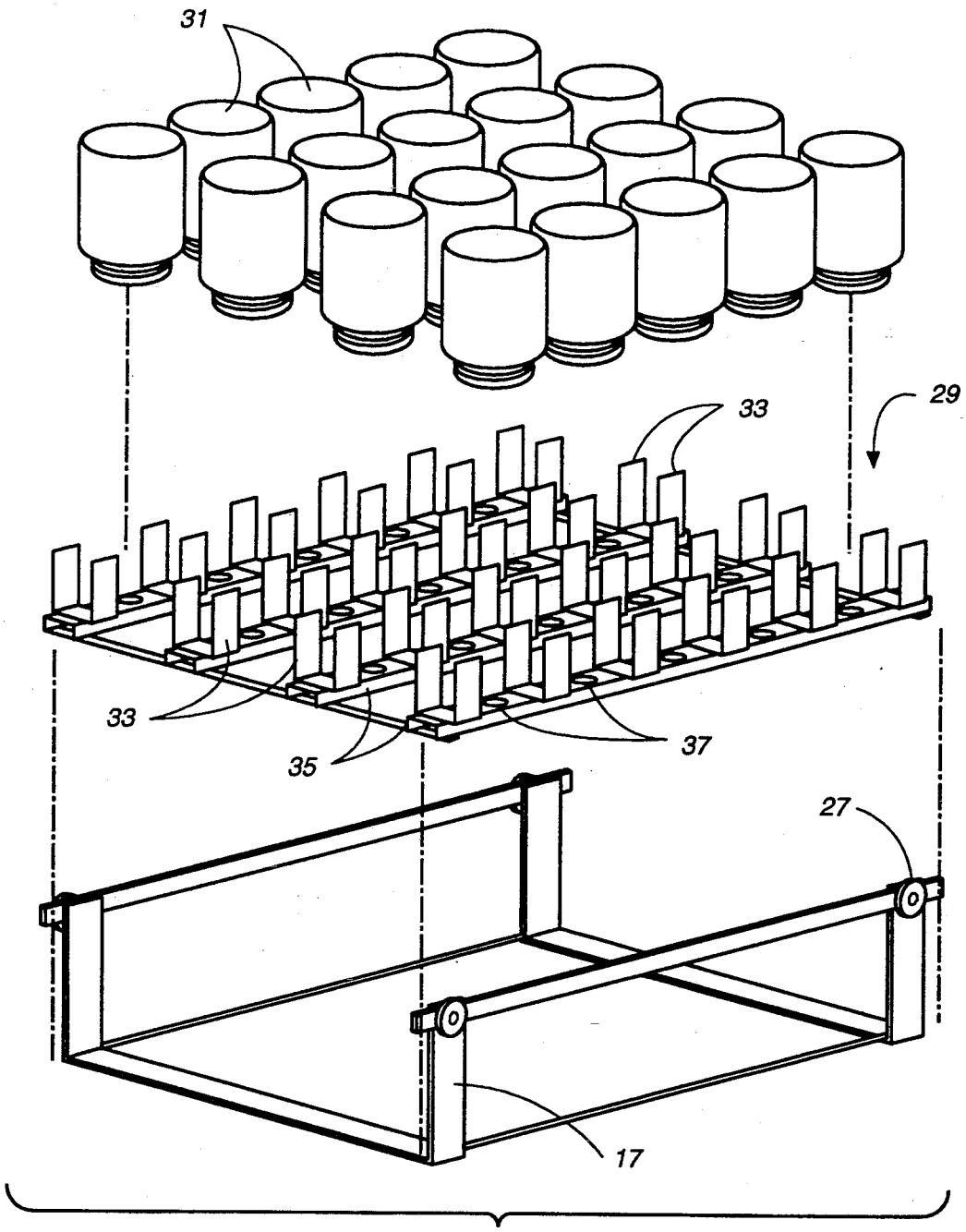
FIG. 2 is a perspective view of a tray and tray insert for supporting containers in an inverted position within the cleaning bay.

Means for supporting an array of containers of different sizes in an inverted position within the cleaning bay are illustrated in FIGS. 1–3. The container supporting means includes horizontal support rails 25 extending through the cleaning bay for movably supporting the container support tray 17 on V-rollers 27 located at the four corners of the tray. As best illustrated in FIGS. 2 and 3, the support tray includes a tray insert 29 that holds an array of containers 31 in an upright, inverted position at the bottom of the tray. The tray insert has spacer elements in the form of upright flange pairs 33 arranged in columns on elongated channel elements 35 having nozzle access holes 37 interspersed between the flange pairs. Adjacent flange pairs provide four upright contact edges, such as edges 39 in FIG. 3D, for holding a container of a given diameter over the nozzle access hole situated between the flange pairs. The known, predetermined spaced relationship of the insert's nozzle element access holes is used as a reference to position the nozzle banks as hereinafter described.

As shown in FIG. 3, a variety of different inserts can be provided to accommodate different container sizes and shapes and to allow for different spacings between containers. For example, in FIGS. 3A and 3D, the upright flange pairs 33 are spaced to accommodate a relatively large diameter bottle 41, whereas the flange pairs of FIGS. 3B and 3E accommodate an intermediate diameter jar 43. The flange pairs illustrated in FIGS. 3C and 3F, on the other hand, have relatively tightly spaced flange pairs to accommodate small diameter vials 45. In each case, the mouths 42, 44, 46 of the containers are positioned over the precisely located nozzle access holes distributed along the support channel of the insert.

Figure 3A:
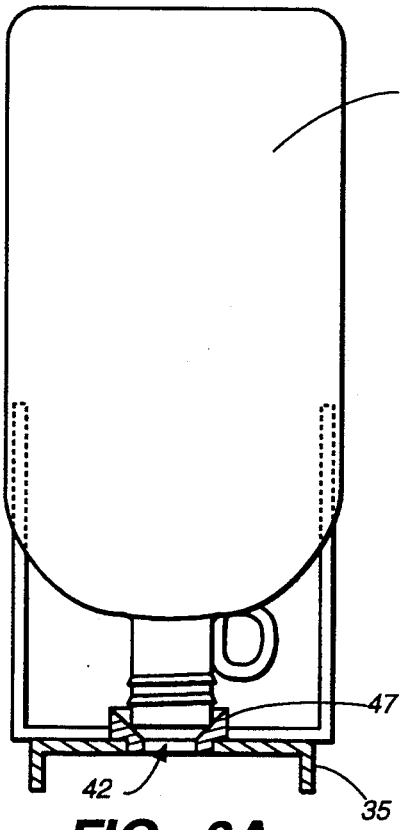
FIG. 3A–3C show profiles of three general types of sample containers loaded onto different appropriately sized tray inserts shown both in partial, cross-sectional front elevational views (FIGS. 3A–3C), and in fragmentary top plan views (FIGS. 3D–3F).
Figure 3B:
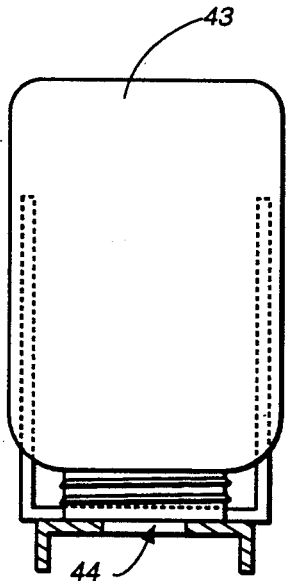
Figure 3C:
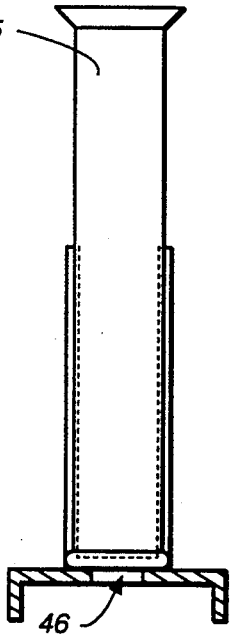
Figure 3D:
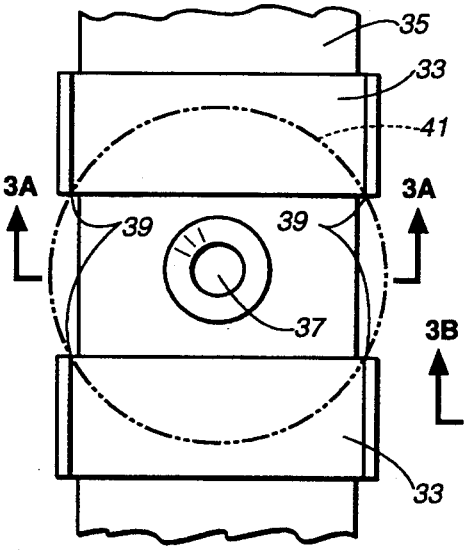
Figure 3E:
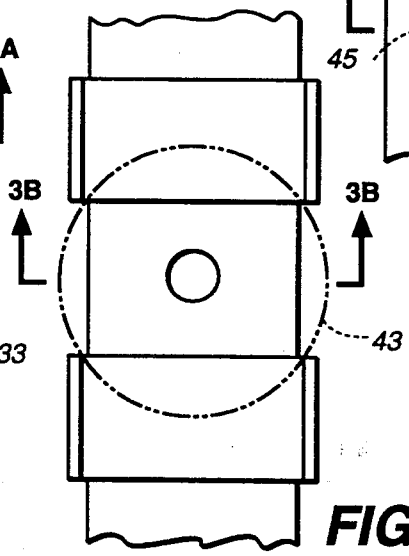
Figure 3F:
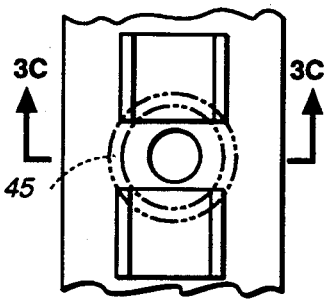

It is noted that each access hole in the insert for holding narrow mouth containers as shown in FIGS. 3A and 3D preferably has a plastic bushing 47 suitably made of Teflon ®, for seating the mouth of the container against the support channel 35. The use of such bushings will minimize the tendency of the lips of narrow mouth glass bottles to chip during processing. It is also noted that, while the inserts for simplicity could provide for the same spacing between containers for all container sizes and shapes, the inserts will preferably adjust the spacing of the containers in accordance with the container diameter so as to maximize the packing of the containers within the tray, thereby maximizing the throughput of containers. As hereinafter described, variations in the spacings between containers will require correspondingly varied spacing for the nozzles elements used to process the containers.

It is further noted that the tray and tray inserts, as well as other parts in the cleaning bay directly exposed to the fluid environment should preferably be fabricated of corrosion resistent stainless steel.

Figure 6:
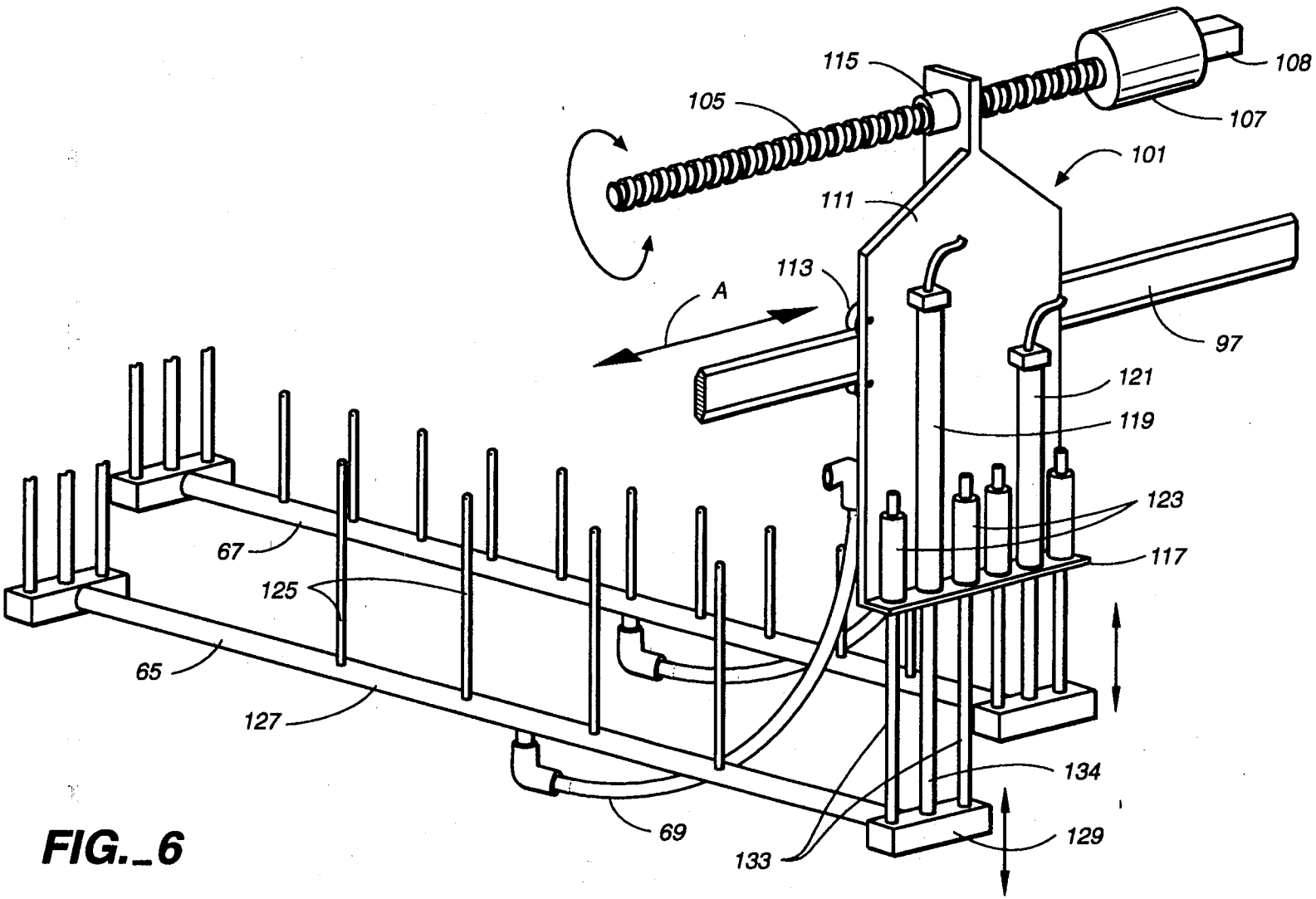
FIG. 6 is a perspective view of the nozzle bank, nozzle bank roller assembly, and drive mechanisms therefor.

FIGS. 4, 5 and 6 illustrate the means by which containers supported in a container support tray are processed through the cleaning bay. Such means includes a means for transporting the container's support tray 17 into and subsequently out of the cleaning bay through the cleaning bay's infeed and outfeed ends 13, 15, and for precisely positioning the tray in the cleaning bay where the tray holds the containers in a fixed horizontal plane for processing. The illustrated transporting means includes dual continuous loop drive chains 49 which travel along an upper horizontal path 50 proximate and parallel to the tray support rails 25, and which are synchronously driven by drive shaft 52 and servo motor 51. Each drive chain has a suitable tray pick-up dog (not shown) and together the pick-up dogs of the dual drive chains pick up a tray that is fed into the cleaning bay's infeed end from a suitable loading platform or from a previous bay; the drive chains subsequently release the tray when it is exited through the outfeed 15 end of the bay.

Precise positioning of the support tray within the bay is accomplished by an encoder 53 which is associated with and responsive to shaft rotation of the servo motor 51. The encoder determines and controls the precise position of the chain in reference to a home position established by home position sensor 55, suitably a photodetector, which detects the passage of a flag 57 on one of the chains. Contact switches 59, 61, 63 are additionally located within the path of travel of the tray to establish that a tray has been fed into the cleaning bay and has actually arrived at the position dictated by the sensory feed-back of the encoder 53 and home position sensor 55. The first contact switch 59 is positioned proximate the infeed end 13 of the bay to signal a tray is arriving, and two additional position contact switches 61, 63 are located such that they both simultaneously contact the tray when the tray has arrived at its approximate processing position. The position contact switches provide a positive indication that the tray has actually arrived under the control of the servo motor and encoder sensory feed-back. These switches can thus signal any mechanical failure that prevents the tray from being properly positioned; they also indicate that the tray is present when the apparatus recovers from an emergency stop or power failure.

FIG. 4 also pictorially depicts a group independently operable nozzle banks 65, 66, 67 and their associated fluid supply lines 69, which are generally positioned below the horizontal plane of the container tray 17 and which are movable along an x-axis (represented by arrow denoted "A") from one end of the container tray to the other (as depicted by the phantom line representation of the nozzle banks). The x-axis movement of the nozzle banks permits a selected nozzle bank to be registered with the open mouth ends of the containers held in the tray, and more specifically with the precisely located nozzle access holes 37 in the tray insert over which the containers are supported. The nozzle banks, with their associated nozzle elements 71, 72, 73 and fluid supply lines, provide means for supplying a stream of fluid to the cleaning bay, and particularly to the inside of the containers when the nozzle banks are processed through the containers in a z-axis motion as hereinafter described. The fluids supplied to the nozzle banks are suitably supplied from a remote fluid reservoir (see FIG. 10) and may consist of a variety of fluids, including tap water, a nitric acid solution, de-ionized water, or air from a compressor for drying.

With further reference to FIG. 4, it is noted that one or more additional spray elements (such as spray element 75) can suitably be provided overhead the container tray to provide an additional source of fluid spray to rinse the exterior surfaces of the containers 31. While it is contemplated that the interior surfaces of the containers will repetitively be processed through a series of cascaded cleaning bays using different solutions, an external spray need only be provided in selected bays as required to meet aesthetic cleanliness standards for the containers non-critical exterior surfaces.

As best seen in FIGS. 4 and 5, fluids supplied through the bay's nozzle elements 71, 72, 73 and external spray element 75 fall into a catch basin 77 at the bottom of the cleaning bay. The catch basin directs the fluids to a central drain 79 through which the fluids can be disposed of, recovered, and/or recycled. Splash guards are suitably provided within the cleaning bay to shield the cleaning bay's various operative parts from the fluids emitted by the bay's nozzle and external spray elements and for directing the fluids into the bay's catch basin. As illustrated in FIG. 5, splash guards include a tray overhead splash guard 81 having opposed downwardly extending channel portions 83, 85 which shield outboard regions 87, 89 housing the moving parts of the nozzle banks. The channel portions of the tray overhead splash guard also shield inboard regions 91, 93 containing the support rails 25 for the tray and the upper horizontal path (as identified by numeral 50 in FIG. 4) of the tray's drive chains. It is further contemplated that vertical splash guards (not shown) will be disposed in front of the chain's vertical path of travel 54. The various splash guards will have an eave effect which cause the splashing fluids within the bay to run down toward the catch basin for removal through the drain. Because there is no vigorous spray action outside of the spray emitted within the containers themselves and the external spray emitted immediately below the tray overhead splash guard, the cleaning bay is able to contain and direct the fluids without the need for special sealing.

The structure and deployment of the nozzle banks and the means for registering the nozzle elements of the nozzle bank with the inverted containers residing in container tray are best illustrated in FIGS. 5 and 6. Before describing these structures, it is preliminarily noted that FIG. 6 illustrates only the first and last one of the nozzle banks 65, 66, 67 diagrammatically illustrated in FIG. 4; the intermediate nozzle bank 66 has been omitted for clarity. It is understood that the number of nozzle banks will depend on the variety of container spacings that the apparatus is designed to accommodate.

The nozzle banks 65 67 are carried on nozzle guide rails 95, 97 by means of roller assemblies 99, 101 that are driven along the guide rails by means of lead screws 103, 105 synchronously driven by stepper motors 107 operatively connected to the ends of each lead screw. Each roller assembly has a vertical carriage plate 111 to the inside of which there are secured two V-roller pairs 113 and a lead screw drive collar member 115, and from the outside bottom edge of which there extends a horizontal cylinder support ledge 117. Each of the independently operable nozzle banks are retractably coupled to the carriage plates of the roller assemblies by means of pneumatic cylinders and linear bearing blocks, such as the illustrated pneumatic cylinders 119, 121 and bearing blocks 123, which, as best shown in FIG. 6, are mounted to the top of the support ledge 117 of the carriage plates.

Each nozzle bank, for example nozzle bank 65, more specifically has a series of elongated nozzle elements 125 extending upwardly from a horizontal manifold 127 which receives a fluid supply through fluid supply lines 69. At each of its ends the manifold is connected via junction blocks 129 to the retractable plunger elements 134 of the pneumatic cylinders 119 and to the two straddling guide rods 133 of the associated bearing blocks 123. As the pneumatic cylinders 119, 121 raise and lower a nozzle bank as further described below, the bearing blocks will act to keep the nozzle bank aligned with the pneumatic cylinder to prevent binding of the plunger within the cylinder.

It can be seen that there are two critical motions of the nozzle banks. First is the x-axis motion in which the nozzle elements of a selected nozzle bank can be registered with the open mouth ends of the containers supported in a resident tray, and a z-axis motion which involves a means for generating a process cycle in which the nozzle elements are caused to traverse through the mouth end of the containers registered therewith. In the z-axis motion, the selected nozzle bank cycles in a forward and return motion as depicted by the vertical arrows in FIG. 6 such that the tip of the nozzle elements travel through the container for a dwell time during which a direct, high pressure stream of fluid sweeps the interior surfaces of the containers. As shown in FIG. 5, multiple Hall Effect sensors 135 are provided along one of the pneumatic cylinders pairs associated with each nozzle bank to provide a means of detecting the forward advance of the nozzle bank so that the nozzle bank's direction of travel can be reversed at a height programmed to correspond with the particular bottle size being processed. The Hall Effect sensors, which require that the pneumatic cylinders be adapted to produce a detectable magnetic field, provide a relatively easily implemented, semi-quantitative feedback system for regulating the nozzle element's direction of travel. It shall be appreciated that other feedback systems could be used, including linear feedback systems that would permit greater control over the nozzle's travel and dwell time characteristics. For example, it might be desirable to have the nozzle elements dwell for a longer period of time at a certain region of the container where greater concentrations of impurities are normally found.

In FIG. 6 it can been seen that the different nozzle banks are provided with nozzle elements having lengths that differ from nozzle bank to nozzle bank. The nozzle bank that will be appropriate for processing particular container sizes will depend on the nozzle length, that is, the nozzle length should enable the nozzle elements of the selected nozzle bank to traverse through the containers being processed to substantially the entire depth of the containers. By providing separate selectable nozzle banks with different nozzle lengths, and by height indexing through feedback from the Hall Effect sensors 135, the cleaning bay will be able to accommodate a wide range of container sizes.

Figure 7A:
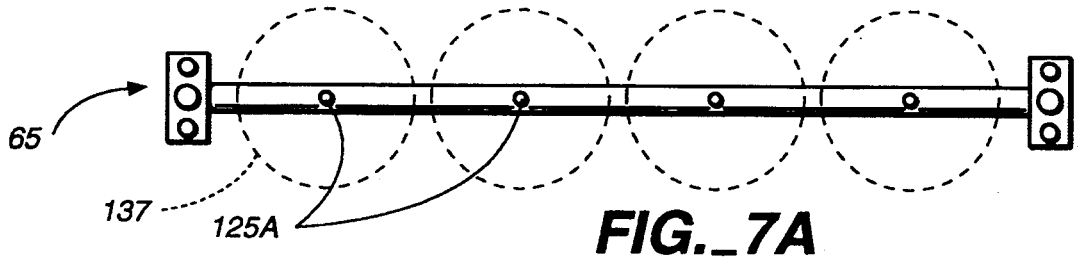
FIGS. 7A–7C are top plan views of three nozzle banks showing different nozzle element spacings relative to different diameter containers shown in phantom lines.
Figure 7B:
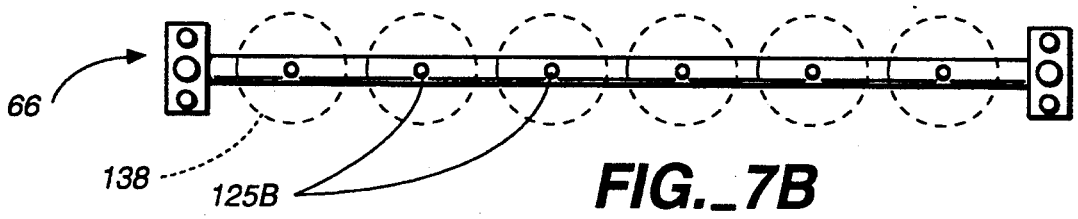
Figure 7C:
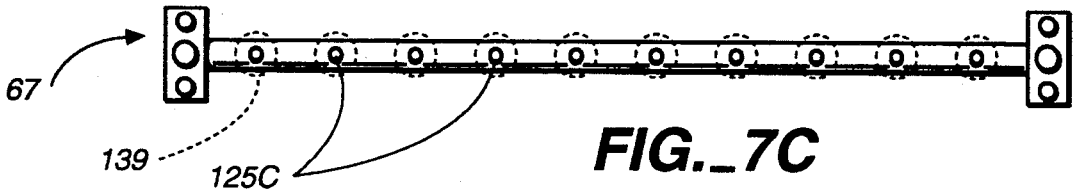

The provision for separate independently operable nozzle banks also enhances the throughput capabilities of the apparatus. FIG. 7A–7C show three nozzle banks 65, 66, 67 (corresponding to the nozzle banks 65, 66, 67 in FIG. 4) having nozzle elements 125A, 125B, 125C of three different spacings that accommodate containers 137, 138, 139 of three different diameters so as to optimize the packing density of the containers. As shown in FIG. 7A, large diameter containers 137 are processed by a nozzle bank having nozzle elements 125A of a relatively wide spacing, whereas FIG. 7C shows a relatively narrow spacing for the nozzle elements 125C for processing relatively small diameter containers 139.

Figure 8A:
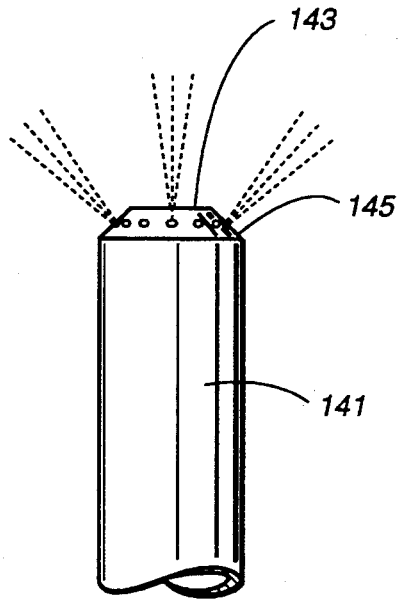
FIGS. 8A and 8B are fragmentary side elevational views of a nozzle element of the nozzle banks showing two alternative designs of the nozzle tip.
Figure 8B:
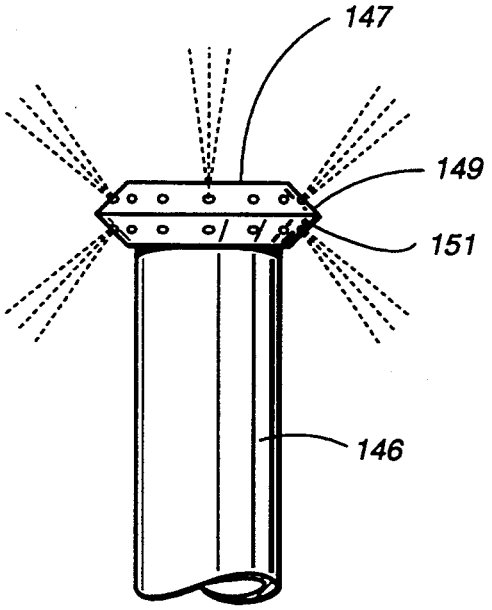

FIGS. 8A and 8C show yet another way in which the nozzle banks can be configured to meet different processing requirements: that is, by providing different nozzle tip designs for providing different spray patterns from the nozzle elements. For example, FIG. 8A shows a nozzle tip 141 having two spray emitting surfaces, a first emitting surface 143 which is a top surface for projecting a forward spray, and a second spray emitting surface 145 which is a forward facing angled surface for projecting a sideward spray. The nozzle tip 146 shown in FIG. 8B on the other hand has, in addition to a first top spray emitting surface 147, both a second spray emitting surface 149 which is a forward facing angled surface, and a third spray emitting surface 151 which is a rearward facing angled surface for projecting a rearward spray of fluid. The nozzle tip design of FIG. 8B would be particularly useful for narrow mouth containers, such as a Boston round bottle, having interior horizontal shoulder surfaces surrounding the container's mouth.

Thus, it can be appreciated that a wide variety of nozzle bank configurations can be provided to meet a wide variety of processing requirements involving different container sizes, shapes and materials. Processing requirements can be met by providing different selectable and independently operable nozzle banks as above described, and by providing for exchangeable nozzle elements within a given nozzle bank. Regardless of the nozzle bank selected or the nozzle configuration used, the processing cycle will be the same for each nozzle bank.

Figure 9:
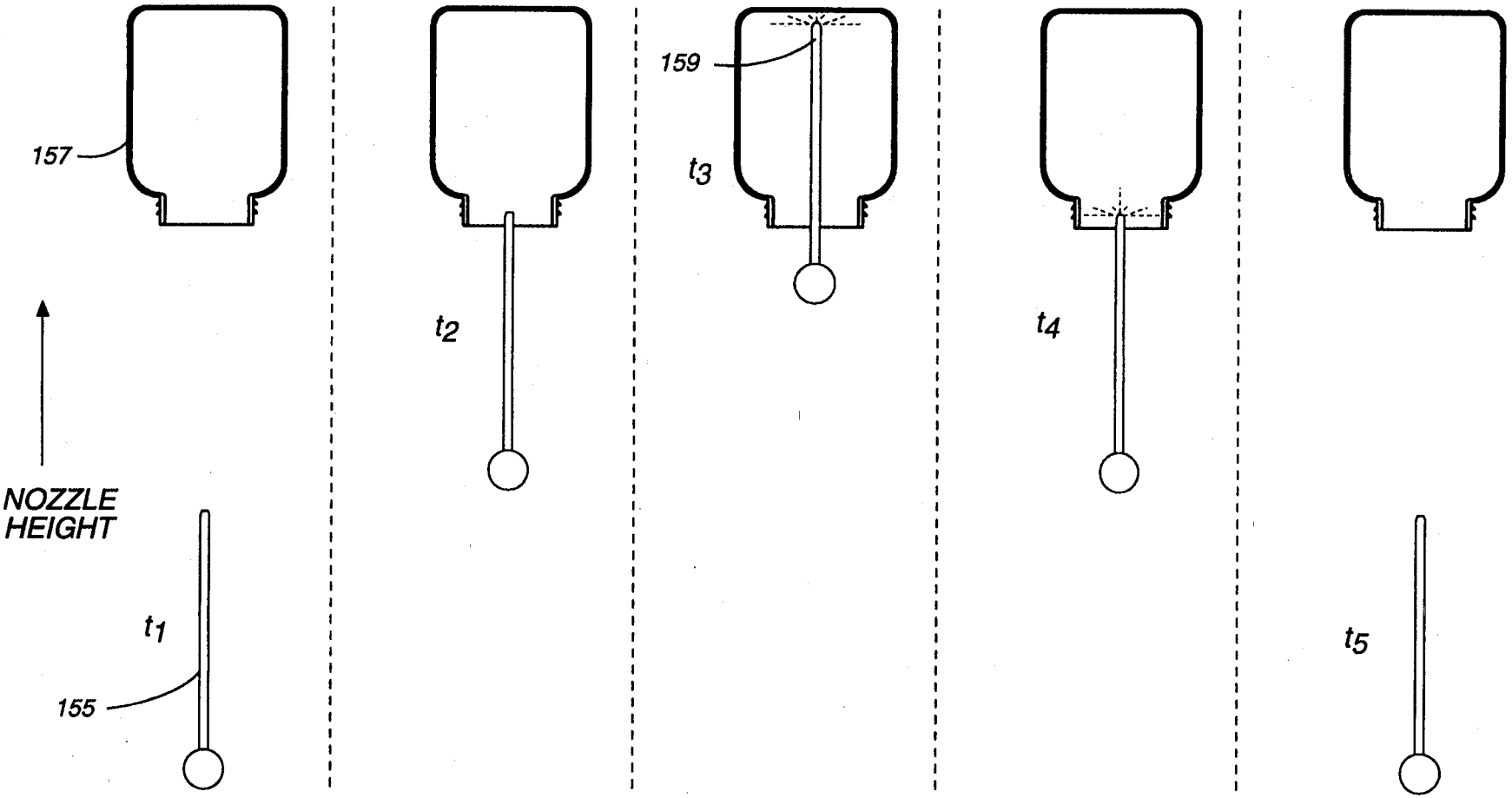
FIG. 9 is a diagrammatic representation of the process cycle of the nozzle bank wherein a nozzle element of the nozzle bank traverses trough the open mouth end of an inverted container.

The processing cycle for a nozzle bank is illustrated in FIG. 9 wherein the movement of one nozzle element 155 of a nozzle bank relative to an inverted container 157 is shown at five different points in the cycle occurring at times $t_1$, $t_2$, $t_3$, $t_4$, and $t_5$. The beginning and end of the cycle occur at times $t_1$ and $t_5$ where the nozzle bank is fully retracted. At $t_3$ the tip 159 of the nozzle has advanced to its full desired height within the container as signalled by the Hall Effect sensors 135 on the pneumatic cylinder associated with the nozzle bank. With feedback from a selected Hall Effect sensor, the nozzle element is caused to reverse direction at $t_3$ so that it retracts to its starting position shown at $t_5$. Also, at $t_3$, fluid control means, operated under the control of the bay central processing unit (CPU) hereinafter described, initiates a fluid stream which remains on while the nozzle element retracts to the position shown at $t_4$, at which time the fluid stream is turned off. Thus, the fluid stream will sweep the interior surfaces of the container for the container's entire length and will only be activated inside of the container thereby conserving fluid and confining the reach of the fluids within the bay. Other sequences of turning the fluid stream on and off are possible, for example, initiating the fluid stream at $t_2$ when the tip of the nozzle element first enters the mouth of the container so as to sweep the container sides in both directions; however, initiating the stream at the height of the nozzle bank's travel minimizes fluid consumption and is a sequence readily implemented by a time-out circuit triggered by the Hall Effect sensor feedback.

The above described process cycle is generated for a nozzle bank selected in accordance with the container size and type to be processed. It is repeated as the selected nozzle bank is moved into registration with each row of containers in the tray from the first row to the last row (see the diagrammatic representation of the nozzle banks in FIG. 4). The means for registering the nozzle elements of the nozzle bank with each row of containers can more specifically be described in reference to FIGS. 4–6, wherein it is seen that synchronous stepper motors 107 rotate the lead screws 103, 105 to precisely advance the nozzle banks carried on the roller assemblies 97 from a known "home" position. A lead screw encoder 108 is operatively connected to at least one of the lead screws to provide sensory feedback that indicates that the nozzle banks have actually moved to where they are supposed to be. If problems arise with any of the lead screw couplings, the effect on the positioning of the nozzle banks will be signaled by the encoder.

It should be noted that the home position of the nozzle banks would logically be at one end of the resident container tray or the other such that the nozzle banks move from a first row of containers to an end row. Preferably, the nozzle banks will successively home to both ends of the tray such that the nozzle bank first processes a tray of containers from a front row of containers to a back row and then processes the next tray of containers from a back row to a front row. Providing two home positions at either end of the tray eliminates the need for the nozzle bank to travel back the length of the container before the next tray can arrive, with the result that overall processing speed is increased.

Figure 10:
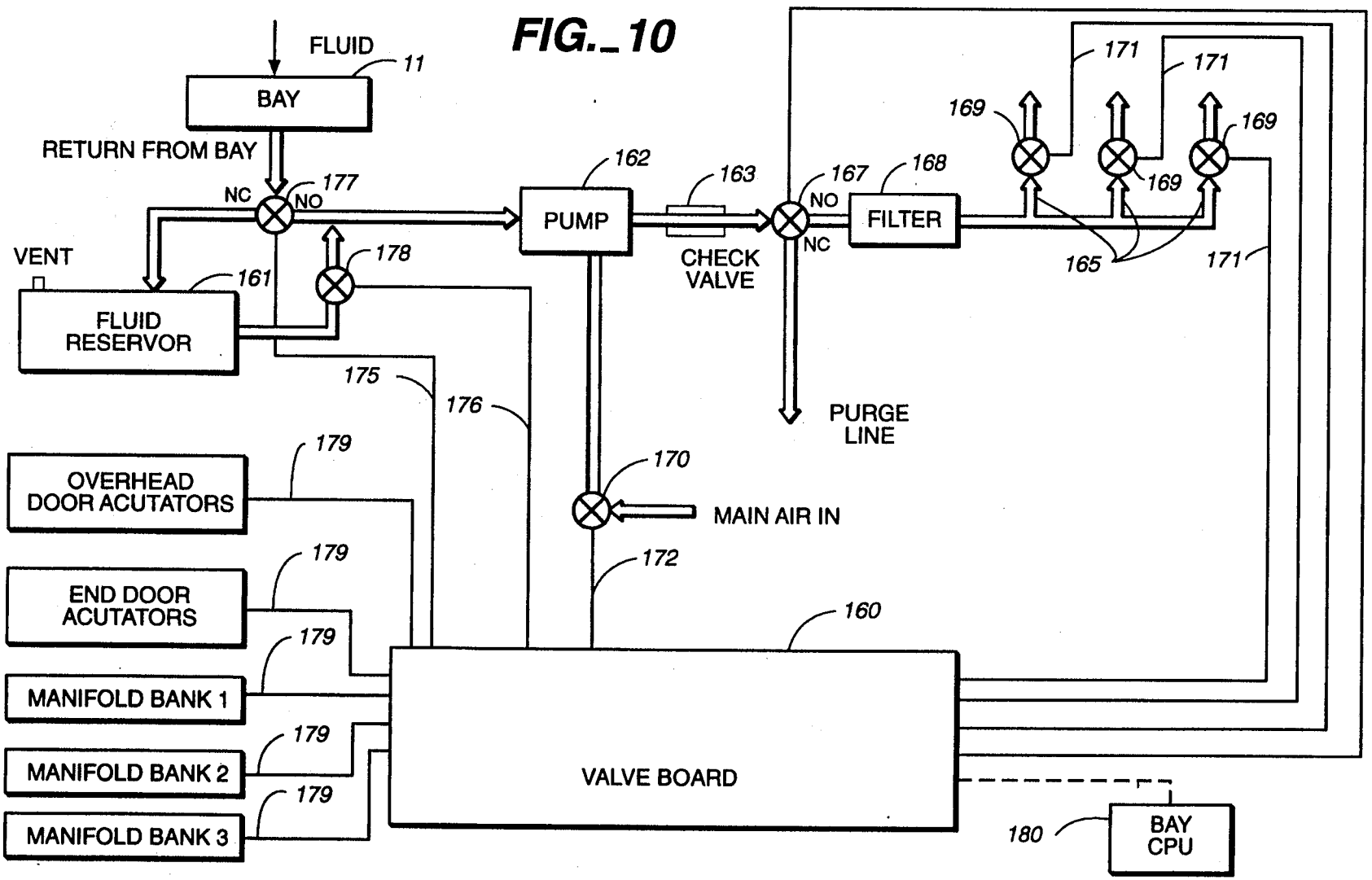
FIG. 10 is a hydraulic and pneumatic circuit diagram generally illustrating the hydraulic and pneumatic controls for operating the cleaning bay.

FIG. 10 is a representative circuit that illustrates the various hydraulic and pneumatic control functions of the cleaning bays. Under the control of the bay CPU 180, the circuits conduct fluids, such as a nitric acid solution, through the system, operate the required control values some of which are suitably located on a valve board 160 mounted to the bay, and actuate the various air cylinders for closing the bay doors and raising the nozzle banks. A compressed air source is provided through valve 170 controlled by pneumatic control line 172. The fluids for the nozzle banks are supplied under pressure from a remote fluid reservoir 161 through a circuit that includes supply valve 178 actuated by pneumatic control line 176, pneumatic pump 162, check valve 163, three-way purge valve 167, hydraulic lines 165, and filter 168. Fluid control means for turning the nozzle bank on and off are provided in the form of two-way nozzle bank valves 169 which are actuated by pneumatic control lines 171. Fluids captured in the catch basin of the cleaning bay 11 are returned through three-way hydraulic valve 177 (which is controlled by pneumatic control line 175) either for recovery or recycling.

The air cylinders which raise and lower the nozzle banks, and the air cylinders for opening and closing the bay doors, including the end doors and the overhead maintenance door, if any, are actuated through suitable pneumatic control lines 179.

Figure 11:
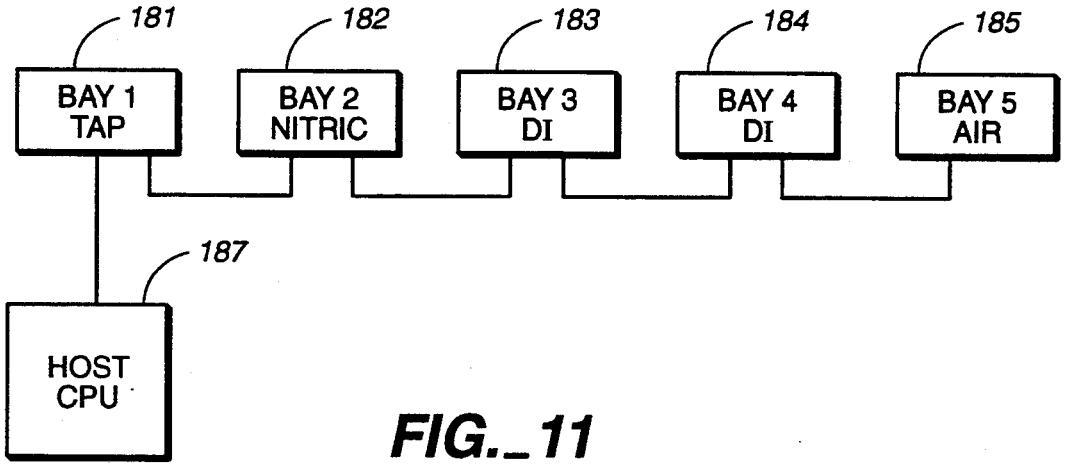
FIG. 11 is a block diagram showing five cleaning bays cascaded together under the supervision of a host central processing unit (cpu).
Figure 12:
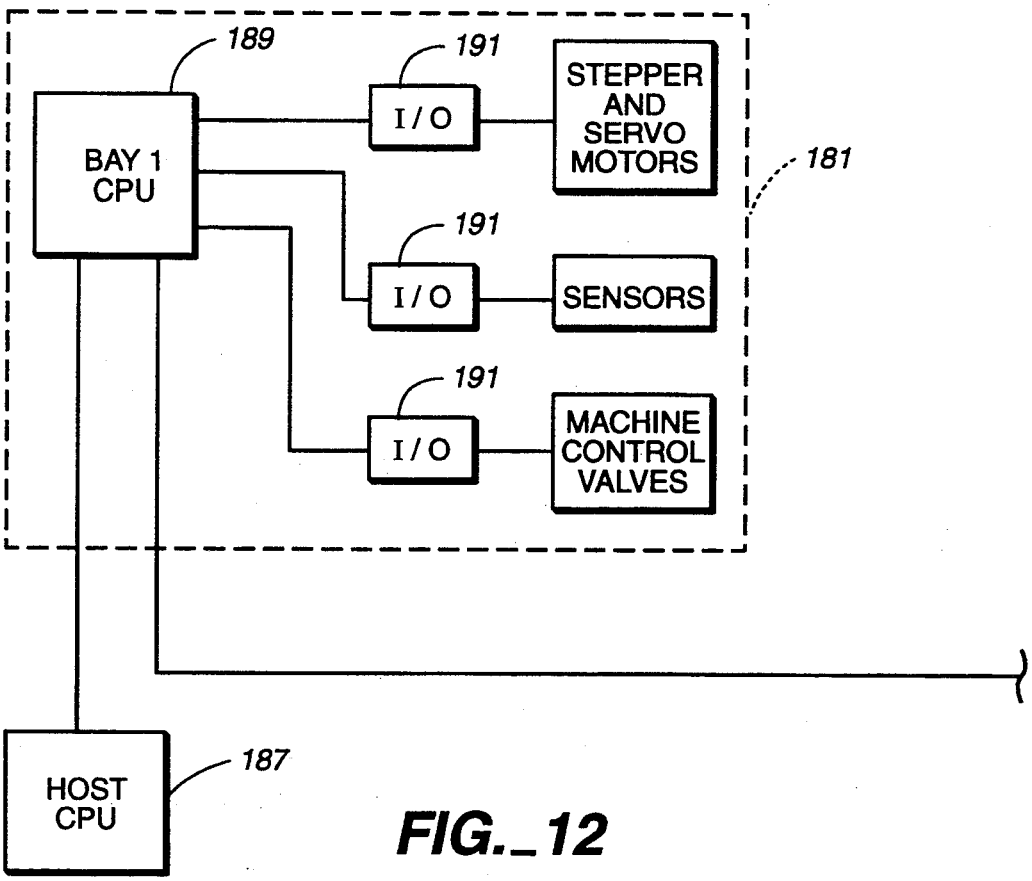
FIG. 12 is a block diagram illustrating the various input/output (I/O) requirements of each bay CPU.

FIGS. 11–12 generally illustrate the configuration by which cascaded cleaning bays are operated under the control of a host CPU and distributed bay CPUs, and FIGS. 14-19 are flow charts describing the software functions by which the host and bay CPUs communicate with each other, process bottle type information, and carry out the necessary machine control functions for processing successive container trays through multiple cleaning bays.

Referring to FIG. 11, five cleaning bays 181, 182, 183, 184, 185 are shown cascaded together under the control of a host CPU 187. As earlier described, each bay processes the containers through selected cleaning and rinse solutions, and can include one or more bays for air drying the containers. In FIG. 11, the sequence is to provide a first bay 181 for a detergent wash using tap water followed by three rinse bays 182, 183, 184 which, in turn, provide a nitric acid rinse and two de-ionized water rinses. The final bay 185 air dries the containers: in this bay the fluid stream emitted by the nozzle banks is air.

As shown in FIG. 12, each cleaning bay has its own local bay CPU 189 to provide local process control. The inputs and the outputs for the motors, sensors, and control valves of the bay are all handled by the bay CPU through suitable I/O ports 191. The bay CPUs for the cascaded bays are preferably daisy-chained together from the host CPU via a serial RS485 communications link for long distance control capabilities.

Figure 13:
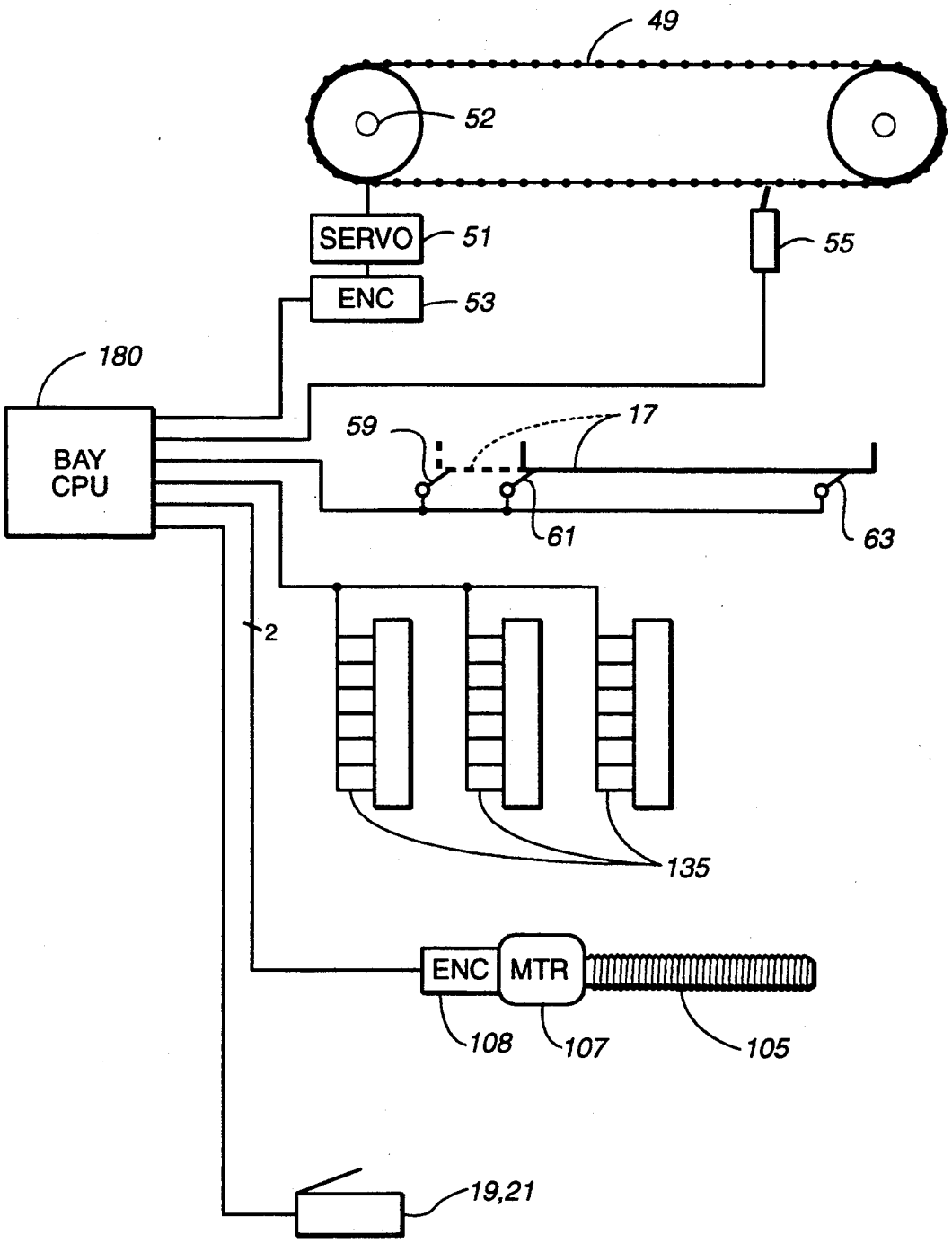
FIG. 13 is a pictorial illustration of the various sensor inputs to the bay CPU for each cleaning bay.

The sensor inputs for each bay CPU are diagrammatically illustrated in FIG. 13 wherein the bay CPU 180 is shown as receiving the following: chain position information from the servo motor encoder 53 and from the chain's home position sensor 55; tray position information from the tray contact switches 59, 61, 63; nozzle bank height or z-axis position information from the Hall Effect sensors 135 on the air cylinder nozzle bank roller assembly; nozzle bank x-axis position from the lead screw encoder 108; and an indication of the position of the end doors 19, 21 such as from suitably located contact switches (not shown).

The host and bay CPUs, each of which can suitably be based on a Zilog 180 microprocessor and each of which has associated memory capacity suitable to its task, have a communication protocol below described which allows the host CPU to poll and send and receive information to and from the individual bay CPUs. This information will include container or bottle type information in a "look-up table" stored in the memory associated with the host CPU. The bottle type look-up table is accessible by the bay CPUs to obtain container height, spacing, and row count criteria for selecting one of the independently operable nozzle banks, for establishing the height of travel of the selected nozzle bank, and for setting the parameters under which the nozzle banks are advanced by the lead screw. Operator access to the host CPU is through a suitable keyboard and display terminal. As described below, the operator, in addition to designating bottle types to be processed, can through keyboard commands also edit the bottle type look-up table to add, delete or change bottle type information. It is understood that programming the CPUs to carry out the functions and capabilities herein described can be accomplished by persons of ordinary skill in the programming arts using routine programming techniques.

Turning to the flow charts of FIGS. 14–19, it is first noted that communications between the host CPU and remote bay CPUs is packet driven, that is, the host CPU continually sends out data packets to the bay CPUs with an address byte which tells which of the bay CPUs it is talking to. The data packets, which may suitably be 20 to 30 bytes long, are capable of addressing the bay CPUs as to their status and as to the type of container being processed. The bay CPU responds by sending a corresponding data packet back to the host CPU, with the information conveyed by the return packet being reflected on the host's display terminal. If a data packet is not returned, or if an error is repeated back to the host, a malfunction of a bay CPU would be evident, at which time the operator can shut down the machine.

Figures 14, 14A, 14B:
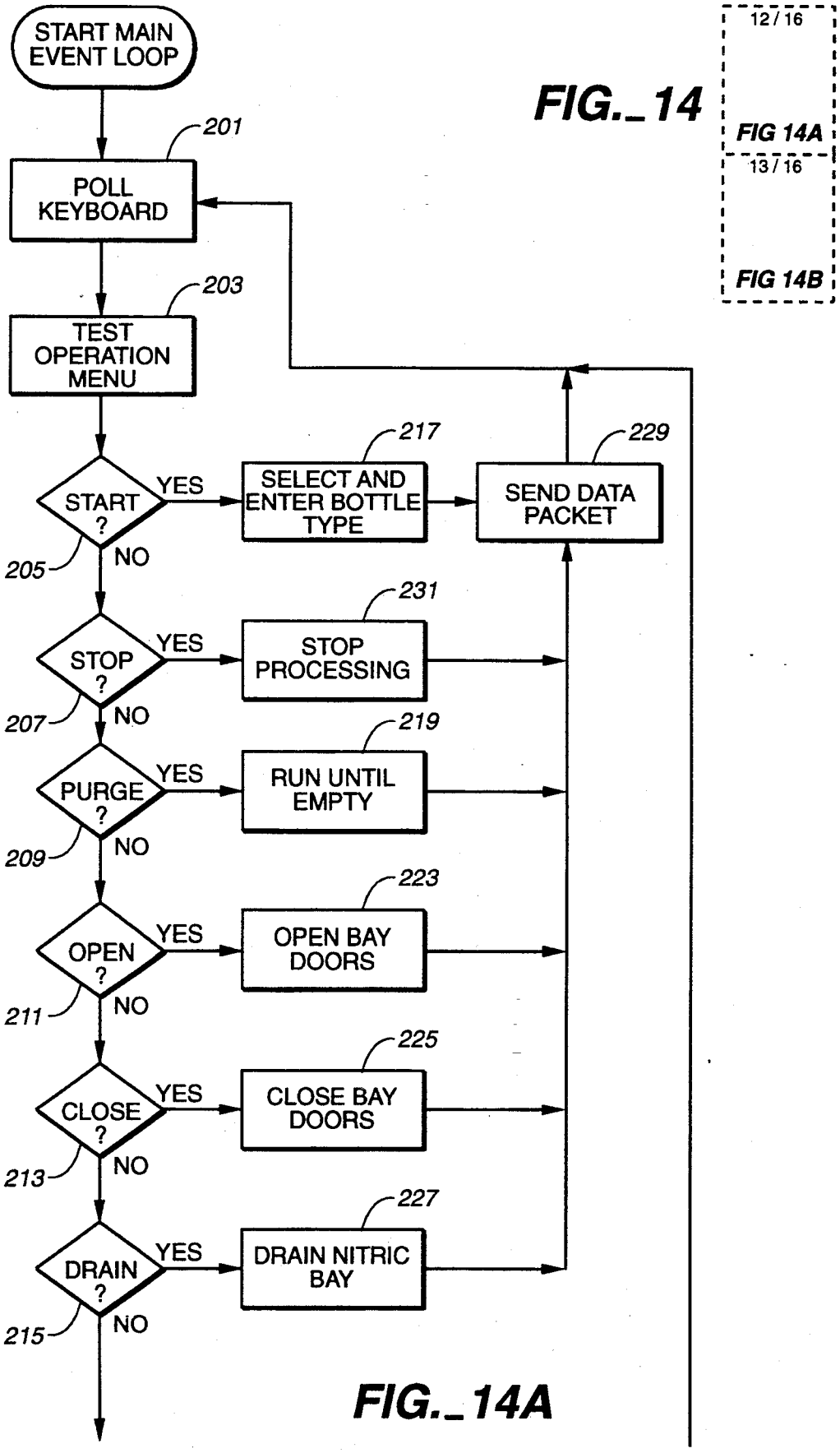
FIGS. 14A and 14B show a flow chart illustrating the operator control features of the host CPU.
Figure 14B:
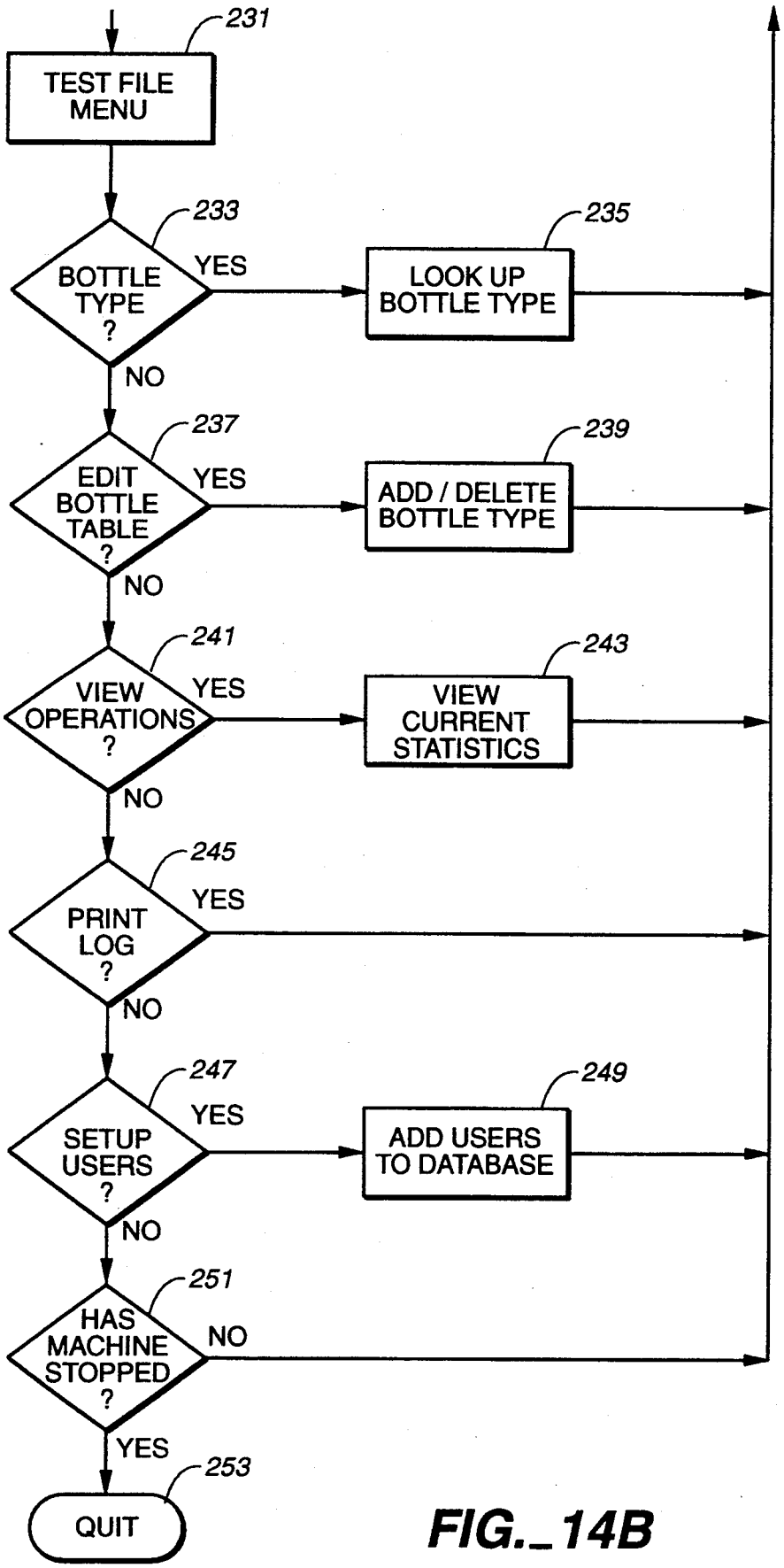

FIGS. 14A and 14B show the main event loop of the host computer in which keyboard commands by an operator are processed by a keyboard polling routine (block 201). The first level of commands is a "Test Operation" screen menu (block 203) in which operator can enter the commands "Start", "Stop", "Purge", "Open", "Close" "Drain" (blocks 205, 207, 209, 211, 213, 215), or other suitable commands all of which cause a data packet (block 229) to be circulated to the bay CPUs. The host processes the keyboard commands (blocks 217, 219, 221, 223, 225, 227) by sending a data packet to the bay CPUs or by taking the operator to a secondary "Test File" menu (block 231) shown in FIG. 14B. From the "Test File" menu the operator can input container (bottle) type information (block 232,235), edit bottle type information (blocks 237, 239), or initiate other operational functions such as viewing current processing statistics relative to previous processing runs (e.g., the number and types of bottles processed in a given time period) (blocks 241, 243). The "Test File" menu also includes a print command (block 245), and a command for adding users to the system by establishing additional user codes (blocks 247, 249). The screen menu program routines will continuously monitor whether the machine has stopped, and will quit when it has (blocks 251, 253).

Figure 15:
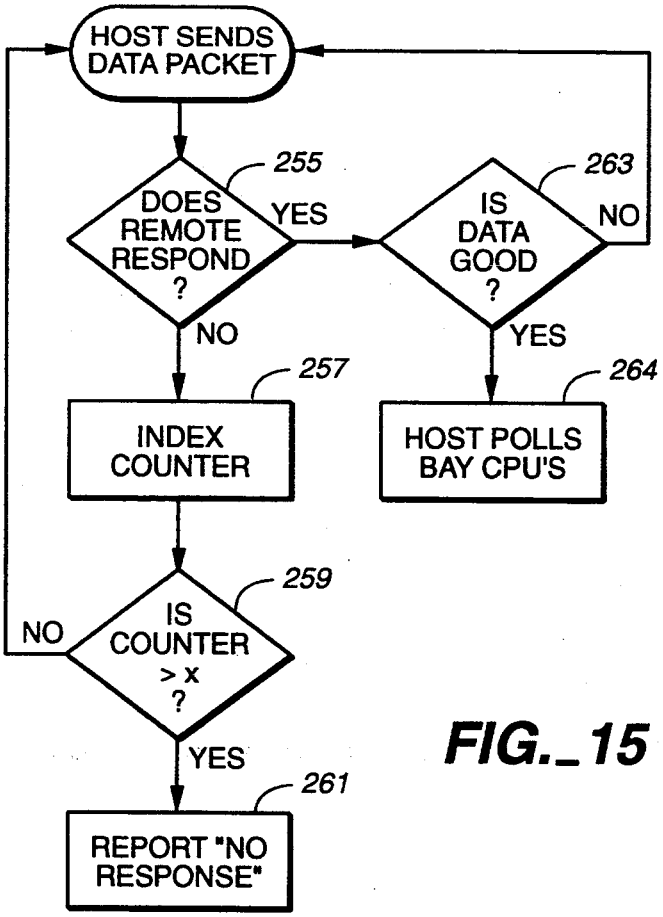
FIG. 15 is a flow chart illustrating the procedure by which the host CPU communicates with the individual bay CPUs.

FIG. 15 generally illustrates the communications routine needed by the host CPU to insure that remote bay CPUs properly receive data packets from the host. This routine tests whether the remote CPU responds within a certain number of tries as determined by a counting routine (blocks 255, 257, 259); if after an "x" number of attempts the addressed CPU does not respond, the host reports a "no response" (block 261) to the operator for appropriate action such as shut down.

Preferably an emergency "STOP" switch (not shown) is provided in the event a host "Stop" command (block 207 of FIG. 14A) is not operative.

The host communication routine can also test the date received back from the CPU to determine if the data is good by using suitable known error checking procedures (blocks 263, 264).

Figure 16:
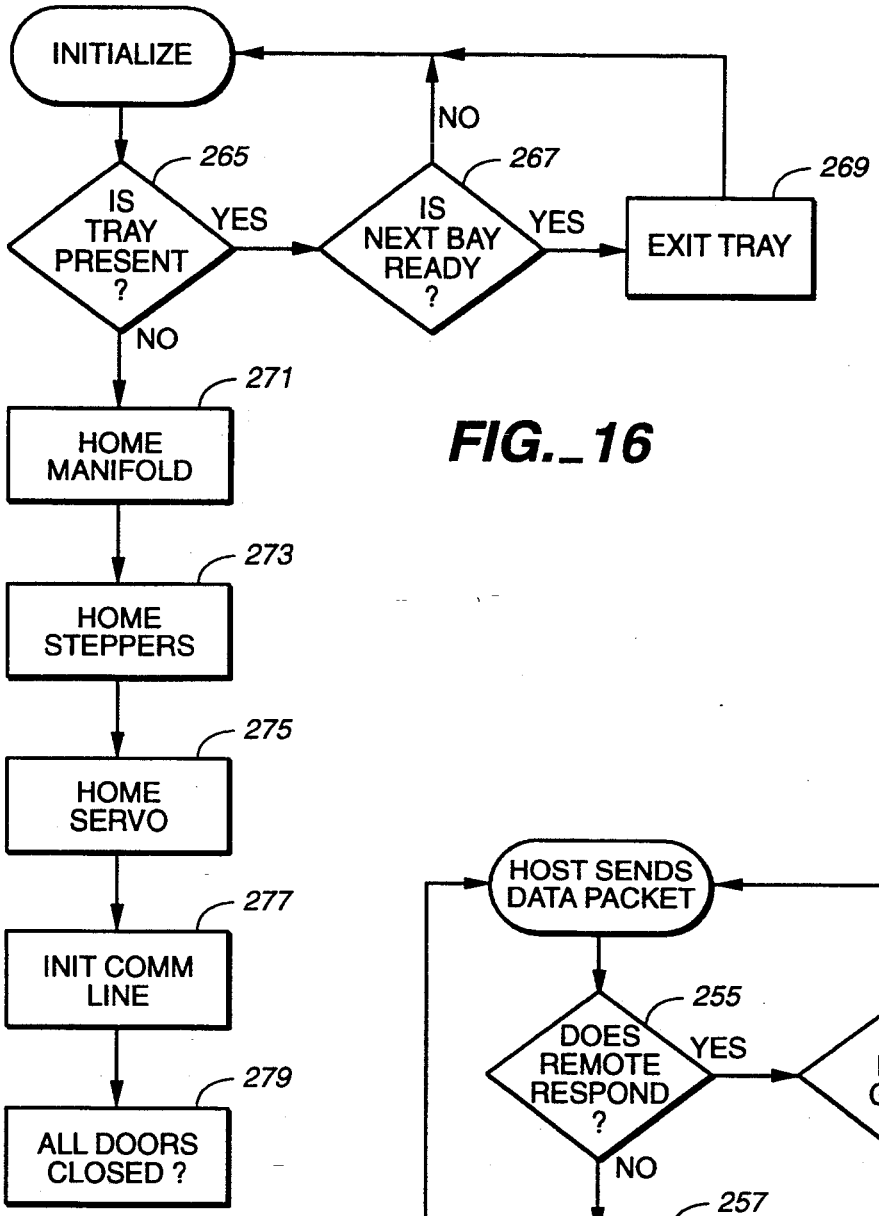
FIG. 16 is a flow chart illustrating the basic initialization function of the bay CPUs.
Figure 17:
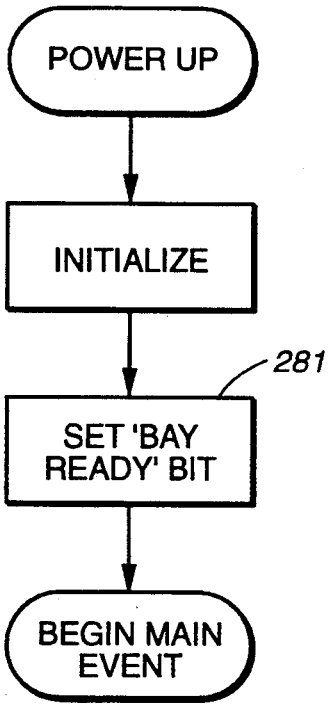
FIG. 17 is a flow chart that illustrates the basic power up sequence of the bay CPUs.

FIGS. 16–19 illustrate the programmed functions of the bay CPUs. As shown in FIGS. 16 and 17 each bay is initialized upon power up. As shown in FIG. 16, initialization involves first testing to see if a tray is resident within the bay and if it is to determine if the next bay in the sequence of cascaded bays is ready to receive the tray (blocks 265, 267). Assuming the next bay is prepared to receive a tray (i.e., it doesn't have a resident tray of its own) or the bay is the last bay, the tray is exited through the out feed end of the bay (block 269). Once the bay is cleared, the CPU directs the bay to move the nozzle banks and drive chain to their home positions in reference to the various above described sensor inputs (blocks 271, 273, 275). The communication lines to the host CPU are also initialized (block 277), and the condition of the bay end doors (and top maintenance door, if any) tested (block 279). The bay CPU of the initialized cleaning bay then indicates it is ready to receive a new container tray by setting a bay ready bit.

Figure 19:
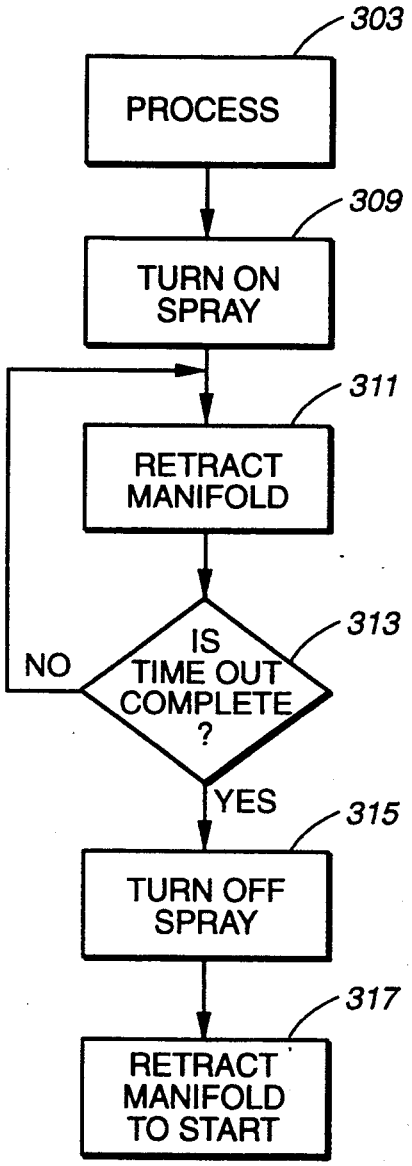
FIG. 19 is a flow chart illustrating the process by which the fluid stream from the nozzle elements is turned on and off.
Figure 18:
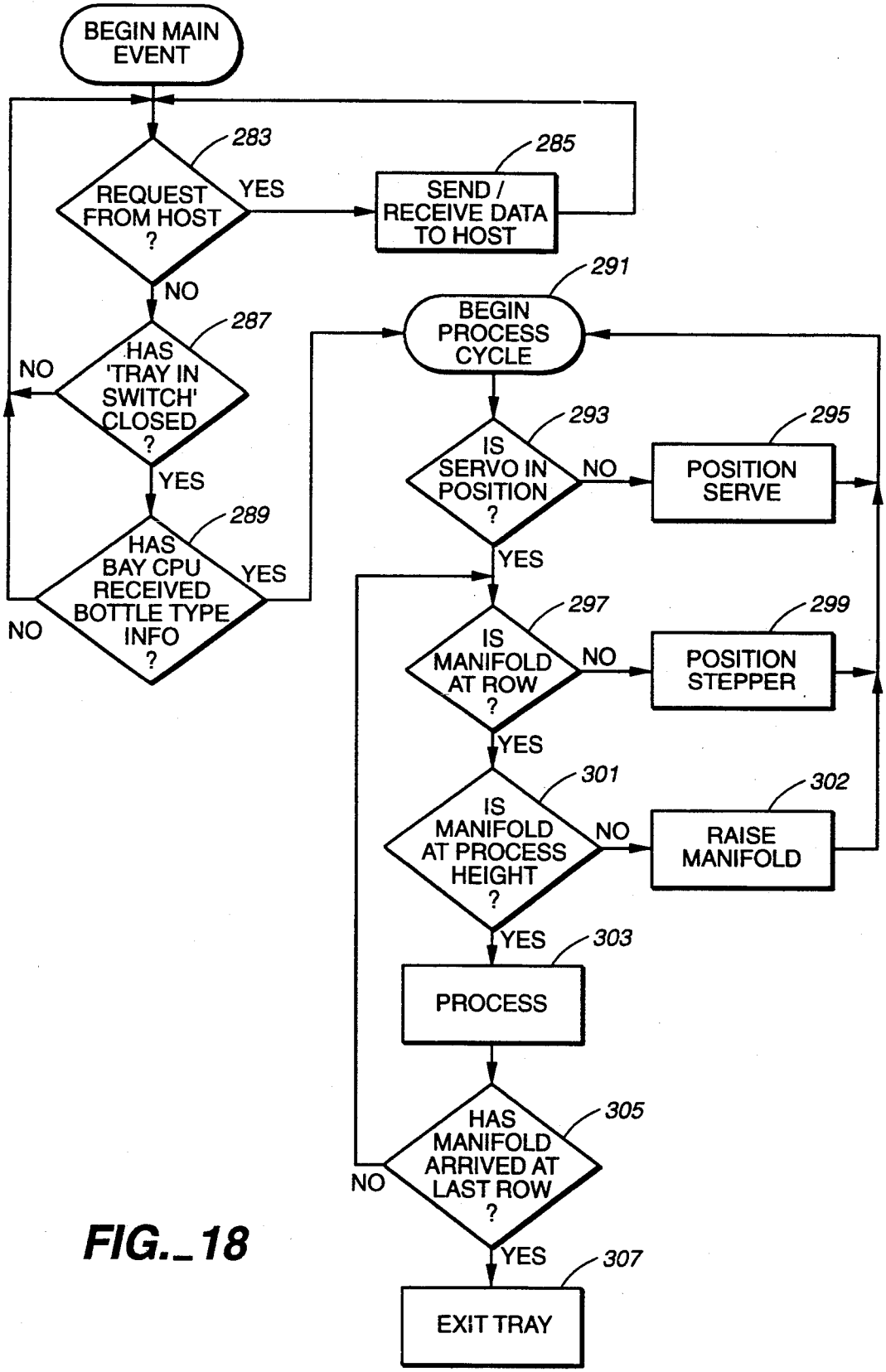
FIG. 18 is a flow chart illustrating the basic operating sequences of each bay CPU in controlling the positioning and movement of the tray and nozzle bank by which the nozzle elements of the nozzle bank are cycled through the containers held by the tray.

The bay ready bit signals to the bay CPU that it can begin the main event loop shown in FIGS. 18 and 19 for processing the tray of containers (see block 281 of FIG. 17). In the main event loop, the CPU continually looks for and responds to data packets (requests) from the host CPU as represented by blocks 283 and 285. It also tests to see if a tray has arrived in the bay from sensory feedback from the tray position contact switches (block 287). Once a tray has arrived, the CPU checks to see if it has received from the host the necessary bottle type information to process the bottles arrayed in the tray (block 289); once the information has been received, it initiates the process cycle illustrated in FIG. 9 for each row of containers held in the tray (block 291).

The process cycle routine begins by establishing from sensory feedback from the servo encoder 53 that the tray has been properly positioned (block 293). If the tray is not in position, it actuates the drive chain's servo motor 51 to correct the position (block 295). The lead screw stepper motor 107 is then actuated to position a selected nozzle bank (manifold) in registration with the first row of containers supported in the tray (blocks 297, 299; also see FIG. 4). The air cylinders on the nozzle bank roller assembly are then actuated to raise the selected nozzle bank to a height determined by the bottle type information received by the bay CPU from the hosts CPUs look up table (blocks 301, 302). When the nozzle bank reaches its designated process height the tips of the nozzle elements will be inserted substantially entirely within the inverted row of bottles being processed at which point the bottles are processed (block 303) as generally illustrated in FIG. 19.

The process routine shown in FIG. 19 is part of the fluid control means by which the fluid of the cleaning bay is turned on and off at the right times. The fluid stream is turned on (block 309) when the nozzle bank is at its maximum height. At this time retraction of the nozzle bank back to its home z-axis position commences (block 313) and after a suitable time-out the fluid stream is turned off (blocks 313, 315). Preferably, the time-out occurs just as the nozzle elements exit the bottles. The time-out interval for the fluid stream can be established by a time-out circuit using the known rate of travel of the nozzle bank and the height of the bottles as reflected in the bottle type look up tables. Following time-out of the fluid stream, the nozzle bank continues to retract to its home or start position (block 317).

Processing a row of bottles as above described is repeated for each row until the nozzle bank arrives at the last row (block 305 of FIG. 18), at which point the tray is exited from the bay (block 307) after the end doors are opened and after it is determined that the next bay, if any, can receive a tray. A tray exited from one bay can be picked up by the next bay by extending the tray support rails between bays and by suitably spacing the bays such that a tray handed off by the drive chain of one bay is picked up by the drive chain of the next bay. Modular bays according to the invention can thusly be cascaded together in any desired number and sequence.

It shall be appreciated that processing the tray of containers in accordance with the invention can be accomplished by means of process steps other than the steps described above. For example, the time out of the fluid stream may be triggered at a point in the z-axis cycle of the nozzle bank other than its maximum height. The fluid stream might alternatively be turned on as the nozzle elements first enter the mouth of the bottle such that the fluid stream sweeps the bottles interior surfaces in both directions of travel. Actuation of the fluid can also be accomplished by means other than a time out circuit, such as by turning the fluid both on and off from sensory feedback from the Hall Effect sensors.

Therefore, it can be seen that the present invention provides an apparatus and method for cleaning containers in which a direct and consistent fluid stream sweeps substantially the entirety of the containers interior surfaces to thoroughly clean these surfaces in accordance with strict standards, such as those set by the EPA for environmental sampling containers. The apparatus and method is particularly adapted to batch processing and provides a batch processing method that increases throughput over conventional hand washing and rinsing methods presently used. The invention has the additional advantage of flexibility, in that, it can be adapted to processing different sizes and types of containers and provides for modular units or bays which can be cascaded together in a desired washing and rinsing sequence. While the present invention has been described in considerable detail in the foregoing specification, it is understood that it is not intended that the invention be limited to such detail, except as necessitated by the following claims.

What we claim is:

1. An apparatus for cleaning containers having an open mouth end comprising a cleaning bay, means for supporting a set of containers in an inverted position and predetermined spaced relationship within said cleaning bay, fluid stream supply means including at least two independently operable nozzle banks disposed within said cleaning bay generally below said container support means, each of said nozzle banks having a set of nozzle elements arranged in correspondence with the spaced relationship of a set of containers supported by said container support means, means for registering the nozzle elements of a selected one of said nozzle banks with the mouth ends of the inverted containers held by said container support means, and means for generating a process cycle during which the nozzle elements of a selected one of said nozzle banks are caused to traverse through the mouth ends of the containers registered therewith to provide a direct fluid stream to inside surfaces of said containers.

2. The apparatus of claim 1 wherein said process cycle generating means is comprised of means for selectively cycling one of said nozzle banks in a forward and return movement so that the set of nozzle elements on the selected nozzle bank are inserted into and retracted from the mouth ends of said set of containers registered therewith.

3. The apparatus of claim 2 wherein the nozzle elements of each of said nozzle banks have a predetermined length and spacing corresponding to different container sizes and different spacings of the containers on said container support means and wherein said nozzle banks are selectively operable in accordance with the size and spacing of the containers loaded onto the container support means.

4. The apparatus of claim 1 wherein said nozzle bank cycling means includes a pneumatic cylinder for each of said nozzle banks, each of said pneumatic cylinders having a plunger element operatively connected to its associated nozzle bank for moving said nozzle bank between a retracted and raised position, and each of said pneumatic cylinders having sensing means for sensing the degree of travel of its associated plunger element for selectively indexing the height to which said nozzle bank is raised.

5. The apparatus of claim 4 further including plunger control means responsive to the plunger travel sensing means associated with each of said nozzle banks for reversing the direction of travel of the plunger element of said nozzle bank at a predetermined height of the raised nozzle bank.

6. The apparatus of claim 5 wherein said plunger travel sensing means includes hall effect sensors distributed at predetermined positions along the path of travel of the plunger element of each of said nozzle banks.

7. The apparatus of claim 5 wherein said process cycle generating means includes fluid control means for selectively activating said fluid stream supply means such that said fluid stream supply means is operative to emit a fluid stream from the nozzle elements of only a selected one of said nozzle banks, and wherein said fluid control means includes a fluid stream time out means responsive to said plunger travel sensing means for producing a fluid stream during the travel of the nozzles of said selected nozzle bank beginning at a selected height of travel of said nozzle elements within the containers registered therewith and ending proximate the mouth end of said containers as the nozzle elements exit said containers.

8. The apparatus of claim 1 wherein said process cycle generating means includes fluid control means for selectively activating said fluid stream supply means such that said fluid stream supply means is operative to emit a fluid stream from the nozzle elements of only a selected one of said nozzle banks substantially only as said nozzle elements traverse through the containers registered therewith.

9. The apparatus of claim 8 wherein said fluid control means includes a fluid stream time out means operative to produce a fluid stream during the travel of the nozzle elements of a selected nozzle bank beginning at a selected height of travel of said nozzle elements within the containers registered therewith and ending proximate the mouth end of said containers as the nozzle elements exit said containers.

10. The apparatus of claim 1 wherein at least one of said nozzle elements having a defined axis includes a nozzle tip having a first emitting surface perpendicular to said axis for projecting a forward stream of fluid from said nozzle element, a second forwardly angled emitting surface for projecting a forward and sideward stream of fluid from said nozzle element, and a third rearwardly angled emitting surface for projecting a sideward and rearward stream of fluid from said nozzle element.

11. The apparatus of claim 1 wherein at least one of said nozzle element includes a nozzle tip having a rearwardly angled emitting surface for projecting a rearward stream of fluid from said nozzle element.

12. The apparatus of claim 1 wherein said fluid stream supply means includes three independently operable nozzle banks, each of said nozzle banks having a set of nozzle elements arranged in correspondence with the spaced relationship of a set of containers of different sizes supported by said container support means.

13. An apparatus for cleaning containers having an open mouth end comprising a cleaning bay, container support means for holding a set of inverted containers of a predetermined size and in a predetermined spaced relationship within said cleaning bay, transporting means for transporting said container support means into and out of said cleaning bay, fluid stream supply means including at least two independently operable nozzle banks disposed within said cleaning bay generally below the transporting means for said container support means, .each of said nozzle banks having a set of elongated nozzle elements for emitting a stream of fluid, the nozzle elements of each of said nozzle banks being different in length and spacing from the nozzle elements of the other of said nozzle banks so that an independently operable nozzle bank can be selected in accordance with the size and spacing of containers loaded onto said container support means, means for registering the nozzle elements of a selected one of said nozzle banks with the mouth ends of the containers held in said container support means, means operative over a defined process cycle for cycling the selected nozzle bank in a forward and return movement that causes the nozzle elements of the selected nozzle bank to traverse through the mouth ends of said set of containers registered therewith, and fluid control means for activating said fluid stream supply means such that a fluid stream is emitted from the nozzle elements of the selected nozzle bank to provide a direct stream of fluid to the inside surfaces of said set of containers when said nozzle elements traverse through said containers.

14. The apparatus of claim 13 wherein said container support means is comprised of a container support tray for holding a set of containers in a predetermined spaced relationship, said container support tray including at least two container support inserts having container spacer elements for holding containers of a predetermined size in a predetermined spaced relationship such that different inserts can be interchangeably used to load different sized containers onto said container support tray.

15. The apparatus of claim 14 wherein said transporting means includes support rails longitudinally extending through said cleaning bay for movably supporting said container support tray, and support tray drive means for picking up and positionably moving said container support tray on said support rails, said drive means including position feedback means for precisely positioning said container support tray along the support rails within said bay to permit the nozzle elements of the selected nozzle bank to register with a set of containers held by said container support tray.

16. The apparatus of claim 13 wherein said container support means holds a set of containers arranged in aligned rows, wherein the nozzle elements of each of said nozzle banks are arranged in a single row corresponding to aligned rows of containers of a predetermined size and spacing, wherein said nozzle registration means includes nozzle bank drive means for advancing the nozzle elements of the selected one of said nozzle banks into successive registration with each row of containers of said set of containers wherein said means for cycling the selected nozzle bank is operative to cycle the selected nozzle bank during a process cycle at each row of containers, and wherein said fluid control means activates said fluid stream supply means during each of said process cycles thereby cleaning the inside surfaces of successive rows of containers.

17. An apparatus for cleaning containers having an open mouth end comprising a cleaning bay, support rails longitudinally extending through said cleaning bay for movably supporting a container support tray wherein said container support tray is adapted to hold a set of inverted containers arranged in aligned rows and in a predetermined spaced relationship and at a defined support plane, support tray drive means for picking up and positionably moving a container support tray on said support rails, said drive means including position feedback means for precisely positioning said container support tray along the support rails within said cleaning bay, fluid stream supply means including at least one nozzle bank disposed within said cleaning bay below said container support plain, said nozzle bank having a set of elongated nozzle elements, said nozzle elements being arranged in an a row of nozzle elements having a spaced relationship which corresponds to the spaced relationship of the rows of inverted containers held on said support tray, nozzle bank drive means for advancing the nozzle elements of said nozzle bank in a motion substantially parallel to said support plane so as to bring said row of nozzle elements into successive registration with different rows of containers held on said support tray, means operative over a defined process cycle for cycling said nozzle bank in a forward and return movement at each row of containers so as to causes said row of nozzle elements to successively traverse through the mouth ends of each row of containers registered therewith, and fluid control means for activating said fluid stream supply means such that a fluid stream is emitted from said row of nozzle elements when said nozzle elements traverse through the each row of containers registered therewith.

18. The apparatus of claim 17 wherein said cleaning bay includes an infeed door, means for actuating said infeed door to permit a container support tray exited from another separate upstream cleaning apparatus to be picked up and fed into said cleaning bay by said support tray drive means, an outfeed door, and means for actuating said outfeed door to permit a container support tray within said cleaning bay to be exited therefrom by said support tray drive means to another downstream cleaning apparatus, said infeed and outfeed doors being operative to fluidly isolated said apparatus from an upstream and downstream cleaning apparatus cascaded therewith during the process cycles of said nozzle bank.

19. A method of cleaning containers having an open mouth end comprised of the steps of selecting a set of containers of a predetermined size and spaced relationship and supporting said set of containers in an inverted position, transporting said supported set of containers to a position which is generally above at least two independently operable nozzle banks wherein each of said nozzle banks has a different arrangement of nozzle elements to correspond with different predetermined spaced relationships of different containers sets of a different size, selecting one of said independently operable nozzle banks in accordance with the size and spaced relationship of the container set supported above said nozzle banks, registering nozzle elements of said selected nozzle bank with the mouth ends of said set of containers, cycling the selected nozzle bank in a forward and return movement to cause said nozzle elements thereof to traverse through the mouth ends of the set of containers registered therewith, and during the cycling of said set of nozzle elements emitting a fluid stream from said set of nozzle elements when said nozzle elements traverse through the mouth ends of said set of container so as to provide direct fluid stream to inside surfaces of said container.

20. The method of claim 19 wherein each of said sets of supported containers are arranged in aligned rows, the nozzle elements of each independently operable nozzle bank are arranged in a row and have a spaced relationship which corresponds to the spaced relationship of the rows of one of the selectable sets of supported containers, and the row of nozzle elements of the selected nozzle bank is successively registered with each successive row of supported containers for a process cycle during which said row of nozzle elements is successively cycled to traverse through each successive row of containers registered therewith.

21. The method of claim 19 wherein the nozzle elements of the selected nozzle bank emit a stream of fluid only when the nozzle elements traverse through said containers.

22. The method of claim 19 wherein the selected nozzle bank is cycled to a height that corresponds to the size of said container and said height is preselected in accordance with the container type to be cleaned.

23. An apparatus for cleaning containers having an open mouth end comprising a cleaning bay, substantially horizontal support rails extending through said cleaning bay for movably supporting container support trays within said cleaning bay and wherein said container support trays are adapted to hold different sets of inverted containers within said cleaning bay, each of such sets of containers being of a predetermined size which is different from the other sets of containers and being arranged in aligned rows and in a predetermined spaced relationship, support tray drive means for picking up and positionably moving a container support tray on said support rails, said drive means including position feedback means for precisely positioning said container support tray along the support rails within said cleaning bay, fluid stream supply means including at least two nozzle banks disposed within said cleaning bay below the plane of the containers held by a container support tray supported on said support rails, each of said nozzle banks having a row of substantially identical and substantially equally spaced nozzle elements, the size and spacing of the nozzle elements of each said nozzle bank being different from the size and spacing of nozzle elements of other nozzle banks such that the different nozzle banks provide a nozzle element size and spacing which correspond to different sized container sets held by said container support tray, nozzle bank drive means for advancing said nozzle banks in a substantially horizontal motion beneath a set of containers held on a container support tray positioned in said cleaning bay so as to bring the row of nozzle elements of a selected one of said nozzle banks into successive registration with different container rows within said set of containers, means operative over a defined process cycle for cycling the selected nozzle bank in a forward and return movement at each row of said set of containers so as to cause the row of nozzle elements of the selected nozzle bank to traverse through the mouth ends of each row of containers registered therewith to provide a direct fluid stream to inside surfaces of said containers, and fluid control means for activating said fluid stream supply means such that a fluid stream is emitted from said row of nozzle elements of the selected nozzle bank when said nozzle elements cycled through each row of containers registered therewith.

24. The apparatus of claim 23 wherein said nozzle bank cycling means includes a pneumatic lifting cylinder for each of said nozzle banks, each of said pneumatic lifting cylinders having a plunger element operatively connected to its associated nozzle bank for moving said nozzle bank between a retracted and raised position, and each of said pneumatic lifting cylinders having plunger element sensing means for sensing the degree of travel of its associated plunger element so that the height to which said nozzle bank is raised can be selectively indexed based on the size of the containers loaded onto the container support means.

25. The apparatus of claim 24 wherein said fluid control means includes fluid stream time out means responsive to said plunger element sensing means and operative to produce a fluid stream during the travel of the nozzle elements of a selected nozzle bank within the containers registered therewith.

26. The apparatus of claim 25 wherein said time out means is operative to produce a fluid stream beginning at the maximum height of travel of said nozzle elements and ending proximate the mouth end of said containers as the nozzle elements exit said containers 27. The apparatus of claim 23 wherein said nozzle bank drive means is further operative to advance the nozzle elements of the selected nozzle bank into registration with successive rows of containers within said container set from a first row to a last row of said container set.

* * * * *